US009358745B2

(12) United States Patent
Petzitillo, Jr. et al.

(10) Patent No.: US 9,358,745 B2
(45) Date of Patent: Jun. 7, 2016

(54) COMPACTOR

(71) Applicant: Wastequip, LLC, Charlotte, NC (US)

(72) Inventors: Anthony D. Petzitillo, Jr., Sicklerville, NJ (US); David M. Grant, Blackwood, NJ (US)

(73) Assignee: WASTEQUIP, LLC, Charlotte, NC (US)

( * ) Notice: Subject to any disclaimer, the term of this patent is extended or adjusted under 35 U.S.C. 154(b) by 99 days.

(21) Appl. No.: 14/317,576

(22) Filed: Jun. 27, 2014

(65) Prior Publication Data

US 2015/0007737 A1 Jan. 8, 2015

Related U.S. Application Data

(60) Provisional application No. 61/840,621, filed on Jun. 28, 2013.

(51) Int. Cl.

| | |
|---|---|
| ***B30B 9/30*** | (2006.01) |
| ***B30B 1/32*** | (2006.01) |
| ***B30B 15/04*** | (2006.01) |

(52) U.S. Cl.

CPC . *B30B 1/32* (2013.01); *B30B 9/305* (2013.01); *B30B 9/3057* (2013.01); *B30B 15/04* (2013.01)

(58) Field of Classification Search

CPC ..... B30B 9/3096; B30B 1/32; B30B 15/04; B30B 9/3042; B30B 9/305; B30B 9/3032; B30B 9/3046; B30B 9/3057; B30B 9/3003; B30B 9/3007; B65F 3/20; B65F 3/201; B65F 3/14; B65F 3/28; B65F 1/16; B65F 1/1405; B65F 1/1426

USPC ..... 100/214, 229 A, 240, 245, 246, 249, 100/250, 252, 269.01, 269.17

See application file for complete search history.

(56) References Cited

U.S. PATENT DOCUMENTS

| | | | | | |
|---|---|---|---|---|---|
| 3,625,140 | A * | 12/1971 | Glanz | B30B 9/3042 | 100/100 |
| 4,557,658 | A * | 12/1985 | Lutz | B30B 9/3042 | 100/193 |
| 4,603,625 | A * | 8/1986 | Brown | B30B 9/3042 | 100/229 A |
| 6,158,336 | A * | 12/2000 | Cambiano | B30B 9/3082 | 100/233 |
| 6,179,520 | B1 * | 1/2001 | Cochran | E02D 3/074 | 172/245 |

* cited by examiner

*Primary Examiner* — Jimmy T Nguyen

(74) *Attorney, Agent, or Firm* — Nelson Mullins Riley & Scarborough LLP

(57) ABSTRACT

A compactor can include a first sidewall, a second sidewall, and a bottom wall, which define a receptacle. The compactor can further include a ram assembly positioned with the receptacle and coupled to a drive assembly. The compactor can further include a frame having a lower longitudinal support member extending between the first sidewall and the second sidewall and an upper longitudinal support member extending between the first sidewall and the second sidewall at the top of the receptacle. A continuous, unobstructed opening is defined between the upper longitudinal support member and the lower longitudinal support member, and a removable cover can be fastened to the frame to overlap the continuous, unobstructed opening.

20 Claims, 20 Drawing Sheets

COMPACTOR

CROSS-REFERENCE TO RELATED APPLICATION

This application claims priority under 35 U.S.C. §119(e) to U.S. Patent Application No. 61/840,621, titled COMPACTOR, filed Jun. 28, 2013, which is hereby incorporated by reference herein in its entirety.

BACKGROUND

This disclosure relates to the field of compactors, for example, compactors for compressing waste or other material into a container. A compactor can include a drive assembly, ram assembly, and/or other working components, for example, which can be positioned within the body of the compactor. In such instances, structural members, supports, and/or panels can block view of and/or access to the interior components. As a result, it can be difficult to access the interior components, for servicing and/or repair, for example, and can be difficult to view the interior components during operation of the compactor. Accordingly, it is an object of this disclosure to provide a robust and compact compactor having viewable and/or accessible interior components.

SUMMARY

A compactor is disclosed. In one general aspect, the compactor can comprise a first sidewall, a second sidewall, and a bottom wall extending between the first sidewall and the second sidewall, wherein the first sidewall, the second sidewall, and the bottom wall can define a receptacle having a top, a first end and a second end. The compactor can further comprise a ram assembly positioned within the receptacle, wherein the ram assembly comprises a leading face configured to translate relative to an axis that extends between the first end and the second end of the receptacle. Furthermore, the compactor can comprise a drive assembly coupled to the ram assembly, wherein the drive assembly comprises a drive cylinder. Additionally, the compactor can comprise a frame positioned at the first end of the receptacle, wherein the drive cylinder is mounted to the frame, and wherein the frame comprises a lower longitudinal support member extending between the first sidewall and the second sidewall and an upper longitudinal support member extending between the first sidewall and the second sidewall at the top of the receptacle, wherein a continuous opening is defined between the upper longitudinal support member and the lower longitudinal support member and extending from the first end of the receptacle to the ram assembly, and wherein the drive cylinder is positioned within the continuous opening. The frame can further comprise a pair of lateral support members extending between the lower longitudinal support member and the upper longitudinal support member. Additionally, the compactor can include a removable cover fastened to the frame, wherein the removable cover overlaps the continuous opening when the removable cover is fastened to the frame.

In another general aspect, the compactor can comprise a first sidewall, a second sidewall, and a bottom wall intermediate the first sidewall and the second sidewall, wherein the first sidewall, the second sidewall, and the bottom wall define a receptacle, and wherein the receptacle comprises a first end and a second end. The compactor can further comprise a frame positioned at the first end, wherein the frame comprises a first longitudinal support member extending between the first sidewall and the second sidewall, and a second longitudinal support member extending between the first sidewall and the second sidewall, wherein an unobstructed opening is defined between the first longitudinal support member and the second longitudinal support member, and wherein the unobstructed opening has a length between the first longitudinal support member and the second longitudinal support member. The frame can further comprise a first lateral support member extending between the first longitudinal support member and the second longitudinal support member and a second lateral support member extending between the first longitudinal support member and the second longitudinal support member. Additionally, the compactor can include a removable cover removably positioned over the unobstructed opening. The compactor can also include a ram assembly positioned within the receptacle, wherein the ram assembly comprises a leading face configured to translate relative to an axis that extends between the first end and the second end of the receptacle. The compactor can also include a drive assembly coupled to the ram assembly, wherein the drive assembly comprises a first hydraulic cylinder mounted to the frame between the first longitudinal support member and the second longitudinal support member, wherein the first hydraulic cylinder has a first diameter, and a second hydraulic cylinder mounted to the frame between the first longitudinal support member and the second longitudinal support member, wherein the second hydraulic cylinder has a second diameter, and wherein the length of the unobstructed opening between the first longitudinal support member and the second longitudinal support member is at least 190% the sum of the first diameter and the second diameter.

In still another general aspect, the compactor can comprise a first sidewall, a second sidewall, and a bottom wall intermediate the first sidewall and the second sidewall, wherein the first sidewall, the second sidewall, and the bottom wall define a receptacle, and wherein the receptacle comprises a first end and a second end. The compactor can further comprise a frame positioned at the first end, wherein the frame comprises a pair of lateral support members, a lower longitudinal support member comprising a guard surface, and an upper longitudinal support member, wherein a continuous opening is defined between the lateral support members, the upper longitudinal support member, and the lower longitudinal support member. The compactor can also include a removable cover removably positioned over the continuous opening. Additionally, the compactor can include a ram assembly positioned within the receptacle, wherein the ram assembly comprises a leading face configured to translate relative to an axis that extends between the first end and the second end of the receptacle. The compactor can further include a drive assembly coupled to the ram assembly, wherein the drive assembly comprises a hydraulic cylinder mounted to the frame and aligned with the continuous opening, and a hydraulic manifold positioned intermediate the frame and the leading face of the ram assembly, wherein the hydraulic manifold is aligned with the guard surface and offset from the continuous opening.

BRIEF DESCRIPTION OF THE DRAWINGS

The accompanying drawings, which are incorporated in and constitute a part of this specification, illustrate embodiments of the invention, and, together with the general description of various embodiments of the invention provided herein, and the detailed description of the embodiments given below, serve to explain various principles of the present invention. In this discussion, the ram assembly is generally described as being advanced to toward the front of the compactor and retracted toward the rear of the compactor; however, such explanation is not intended to be limiting. Moreover, expressions of direction, such as "in front", "behind", "above", "below", "left", "right", "forward," and/or "rearward" should be construed to refer to the relative positions and orientations in the figure being described and not to require a particular orientation of the compactor or its components.

DETAILED DESCRIPTION

Figure 1:
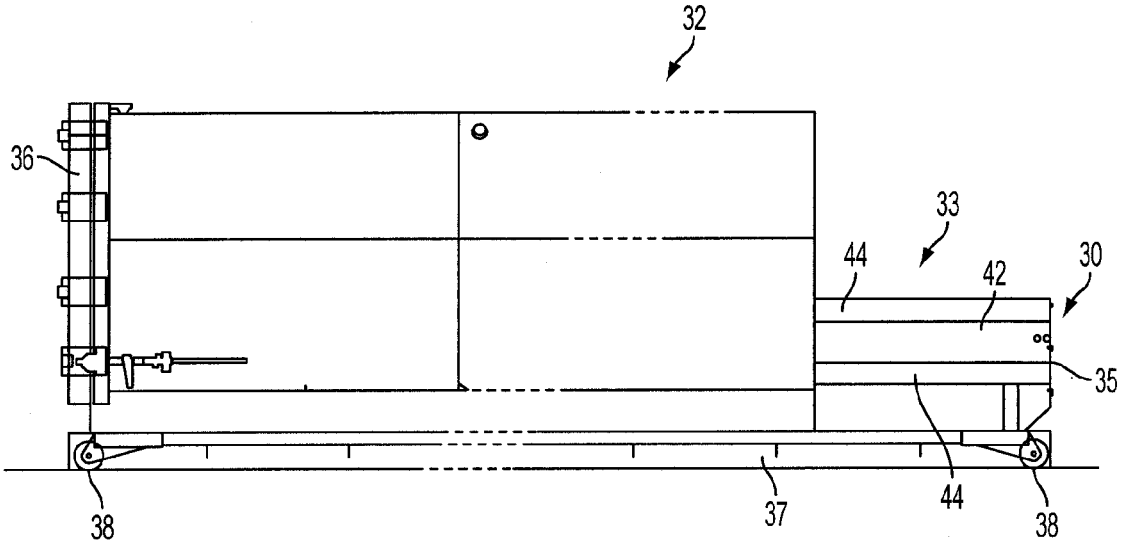
FIG. 1 is a side elevation view of a self-contained compactor unit comprising a compactor head and an associated compressed material container, according to various embodiments of the present disclosure.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Uses of the phrases "in various embodiments," "in some embodiments," "in one embodiment", or "in an embodiment", or the like, throughout the specification are not necessarily all referring to the same embodiment. Furthermore, the particular features, structures, or characteristics of one or more embodiments may be combined in any suitable manner in one or more other embodiments. Such modifications and variations are intended to be included within the scope of the present invention.

Compactors vary in size and configuration. A compactor head may be temporarily or permanently coupled to a compressed material container, and may be operated to press material by horizontal, vertical, and/or pivoting movement of a compression member. The compression member can comprise a ram that is advanced across a material charging area or hopper, in a direction that presses loose material into the container. Auger arrangements also are possible.

In the present examples, a ram with a pushing face occupies most or all of an end wall defining the charge box or hopper. The ram is normally retracted into an enclosure at that end wall, but is movable during a compaction cycle, for example, by at least one extension element coupled between a frame and the ram.

In one embodiment, the extension element(s) include diagonally crossing hydraulic cylinders. In other embodiments, the extension element(s) include one or more longitudinally extending hydraulic cylinder. The cylinder(s) advance the face of the ram across the charge box so as to push any material in the charge box through an outlet opening on the opposite end of the charge box, which is attached at the inlet opening into the compressed material container. In successive strokes of the ram, charges of material are pressed into the container one after another. The ram stroke is preferably sufficient to advance slightly beyond the opening and into the container at the ram's greatest extension. The ram is retracted between strokes to clear the hopper in front of the ram for receiving a next charge of material.

In a pushing arrangement with diagonally crossing hydraulic cylinders, the ends of the cylinders are pivotally coupled at laterally spaced fittings on the back side of the ram and at laterally spaced fittings on the stationary backing structures from which the ram is advanced forward during a compaction stroke. Such a crossing-cylinder pushing structure can be made compact in the retracted position of the ram, by dimensioning the structure so that the hydraulic cylinders are at a small acute angle relative to the plane or face of the ram when the cylinders are retracted. The pivotal couplings for the ram, typically comprising heavy duty pivot pins, for example, are widely spaced on the back side of the ram and also on the rear stationary structures. As the cylinders extend, the ram cylinders pivot from a retracted orientation, in which the crossing cylinders are more parallel to the face or plane of the ram, toward a ram-advanced orientation, in which the cylinders are more perpendicular to the ram, i.e., more parallel to the direction of ram advance.

As a result of the cylinders being oriented more perpendicular to the direction of ram advance when retracted, the force that is exerted by the two crossed hydraulic cylinders has a large component directed laterally outwardly relative to the direction of ram advance when the ram is retracted. At the beginning of a forward stroke of the ram, the diagonally deeply-folded retracted cylinders have a large force component seeking to push outwardly between the laterally spaced cylinder mounts on the back side of the ram and also between the laterally spaced cylinder mounts on the stationary frame members that carry the ram. As the ram stroke extends, the force component becomes more forward/rearward along the ram stroke because the hydraulic cylinders pivot, and when the cylinders are extended, the longitudinal axes of the cylinders better align to the longitudinal advance of the ram. Likewise when retracting the ram, when the cylinders are most deeply folded over one another, the cylinders exert a large inward compression component between the spaced cylinder mounts on the ram and on the stationary structure. In view of the large lateral force component near full retraction of the ram, the stationary structure of the compactor head conventionally has a heavy structural member placed directly between the spaced cylinder mounts on the stationary frame. In other words, in certain instances, the stationary structure or rear frame of the compactor head can include a structural member extending horizontally between opposing lateral sides of the rear frame. The ram pusher plate and/or reinforcing members that are provided on the back of the ram pusher plate can likewise include heavy structural members to bear tension and compression that is nearly equal to the full force exerted along the axis of the hydraulic cylinders when retracted.

In an exemplary arrangement generally known as a self-contained compactor, the compactor head is permanently mounted on one end of a rectangular container that is elongated in the direction of the ram stroke. The self-contained compactor can be drawn by a cable and winch, for example, onto a roll-off truck with a tiltable chassis. The compactor unit, including the container, is transported as a unit to a discharge area where the container is tilted, container side down, to dump the compacted contents of the container through one or more doors that can be opened on the end of the container opposite from the end having the compactor head.

A compactor head that is attached to the compactor container is dead weight during transport of a self-contained compactor. Assuming that the ram operates in the direction of elongation of the container, the charge box and the ram drive mechanism extend the length of the self-contained compactor beyond the length of the container holding the load. Preferably, the charge box and the ram drive are no larger and/or heavier than necessary. On the other hand, a relatively heavy and robust ram structure is less susceptible to wear and damage in use, and the charge box advantageously is dimensioned to receive a good sized load of material to be compacted for each advance and retraction of the ram. There are tradeoffs as to size and weight of the compactor head and the ram and ram driving elements, and it is advantageous to make efficient use of available space.

In one arrangement, the compactor head is configured with a rectilinear frame, closed by panels on the bottom and lateral sides, and open at the ram discharge end (facing the opening into the container). The ram fits closely against the bottom and lateral sides for pushing the material forward like a piston in a cylinder. Advantageously, there is little clearance between the ram and the bottom and side panels that might permit material to become wedged between the ram and the panels.

A mechanism typically comprising one or more hydraulic cylinders is mounted to the frame behind the ram. The mechanism exerts force in either opposite direction between the ram and the frame, i.e., to forcibly advance the ram through the charge box, or to retract the ram into the rear of the frame to clear the charge box for a next load of material.

It would be possible to mount one or more hydraulic cylinders so as to advance and retract along a line parallel to the direction of advance and retraction of the ram. In other words, the hydraulic cylinder can extend longitudinally relative to the compactor head, i.e., parallel to the lateral sides of the compactor head and/or parallel to the driving movement of the ram. For example, the movable shaft of a hydraulic cylinder might be fixed at one of its end to the ram, with the body of the hydraulic cylinder attached to the framing of the cylinder head. That configuration would require that the rear part of the framing and/or the mechanism including the body of the hydraulic cylinder extend in the direction of elongation of the container, which is not efficient in terms of space. In other instances, one or more hydraulic cylinders can be mounted diagonally in the rear part of frame, or coupled to linkages that extend in a parallelogram or scissoring linkage that advances and retracts the ram without contributing so much to the length of the overall compactor.

Depending on the nature of the ram and the manner in which the ram is held in the frame and forced to advance and retract, and also in the case when the load is not evenly distributed in the charge box or becomes wedged between the ram and the charge box surfaces, forces can arise between the ram and the panels that define the charge box. These forces can press outwardly on the panels, for example, when the ram is subjected to racking forces seeking to displace the ram diagonally relative to the panels that guide the ram. In order to deal with this issue, the panels that define the charge box might be made thick or might be reinforced on the outside. These aspects contribute to the size and weight of the compactor head.

The ram may be defined by a leading face plate of heavy steel, on at least a partial box structure that extends behind the face plate and slides along the charge box bottom and side panels. If the box structure behind the ram face is made relatively longer in the advance/retract direction, then the ram is more positively guided and less susceptible to racking. This represents another tradeoff of durability versus size and weight.

With a horizontally movable ram, material to be compacted might be introduced vertically or laterally into the charge box in front of the ram. Advantageously, material is introduced vertically from above, dropping by gravity into the charge box through a vertical loading chute or other passage such as a lateral opening in an entry box (termed a dog house), or perhaps being dumped into the charge box using an apparatus such as a tipping apparatus for a dumping bin or an elevating conveyor belt.

The ram advances horizontally across the box-shaped reception area to move and press material from the reception area into the container. When the ram is retracted, material disposed above the ram falls into the charge box in front of the ram, in position to be engaged by the next ram stroke. In order to keep material from getting behind the ram face panel when the ram is advanced, the ram can have panels forming at least the top of an elongated ram piston, carried along with the plate forming the leading face of the ram and keeping material from falling behind the ram. It would be possible to make the top panel of the ram slightly longer than the length of the charge box in the direction of ram advance. Likewise, side and bottom panels attached behind the ram face panel can form a ram piston that inhibits the extent to which material can wedge between the ram and the charge box panels and bypass the ram face plate. A ram piston/charge box sliding structure that engages over a substantial length in the direction of ram movement is well supported against racking. But in an extreme case, the ram piston needs to be at least slightly longer than the length of the charge box, which would be undesirable.

For these and other reasons, there are challenges associated with the configuration of compactor heads, especially for self-contained compactors that are configured for transport on roll-off trucks. What is needed are ways to optimize for compact size, minimum weight and maximum durability. This disclosure concerns ways to balance these interests in an efficient configuration. In various instances, this disclosure provides a durable compactor head that is limited in weight, has a relatively short length in the ram stroke direction, and has a mechanism that is accessible for servicing.

Self-contained compactors according to this general description are available from Wastequip, Inc., Marathon Equipment Co., J.V. Manufacturing, Inc. and others. Some of the solutions found in this disclosure are likewise applicable to other compactor arrangements such as those wherein the container is detachable from the compactor head, and arrangements that use other specific ram structures and ram motions.

An object of this disclosure is to optimize the structure of a compactor head, especially for a self-contained compactor, but also applicable to detachable compactor head and container assemblies. In various instances, the compactor head is associated with a container having an inlet opening into which material is to be compressed by a ram. The compactor head can have a charge box, and the ram can be movably mounted in the compactor head to traverse the charge box so as to press material from the charge box into the container.

In various instances, the ram and the advance/retract mechanism for the ram, i.e., the drive assembly, are mounted on a stationary frame so as to advance and retract the ram through the charge box, to and from the inlet opening. In certain instances, the frame is lined with bottom and side panels attached to the frame. The ram can define a piston that is complementary to the cross section of the charge box. In one embodiment, the ram rests on the bottom panel and is guided by the surfaces of the bottom and side panels. In another embodiment, the ram is suspended and guided upon at least one runner attached along the inside of each of the two opposite side walls. For example, the runners can extend parallel to the direction of advance and retraction of the ram. In alternative arrangements, two or more runners can be provided on each sidewall and/or one or more additional runners can be provided along the inside of the bottom panel, for example.

The frame can comprise rectangular tubing or solid bar stock or steel plate, with elongated frame parts arranged in a rectilinear shape and welded at junctions, such that open spaces are defined between vertically spaced horizontally oriented frame members, or headers, and laterally spaced vertically oriented frame members, or stiles. In various instances, the side of the frame facing the container opening remains open, and forms the opening through which material is pushed by the ram.

In certain instances, the ram advance/retract mechanism comprises at least one diagonally mounted element extending from the frame to the ram for moving the ram over a longitudinal path. In one embodiment, at least two diagonally crossed hydraulic cylinders are extended from the rear corners of the frame to a rear corner of the ram on the laterally opposite side. As the cylinders extend during advancement of the ram toward its maximum extension, for example, the cylinders rotate or pivot closer to an orientation parallel to the longitudinal axis of ram movement. As the ram is retracted, for example, the cylinders rotate or pivot to an orientation more perpendicular to the axis of the ram movement.

In certain instances, the diagonally crossed hydraulic cylinders are coupled to laterally spaced pivot pin mounts on the rear side of the ram pusher and to laterally spaced pivot pin mountings at the stationary frame carrying the ram. For example, the two cylinders are placed immediately adjacent one another so that the tension and compression forces between the pivot pin mounts remain nearly in one plane. To maximize the ram stroke length between a very compactly folded position and a position of maximum advance, the cylinder pivot pin mountings can be widely spaced, at least on the stationary frame at the rear. For example, the cylinder pivot pin mounts are located at the extreme rear corners of the frame of the compactor head, and the crossed cylinders are coupled at their opposite ends to cylinder pivot pin mounts that are laterally spaced on the back of the ram pusher plate. In various instances, the ram pusher plate is a heavy plate backed by lateral reinforcing members that are robust enough to bear the full force of tension and compression from the cylinders.

It would conventionally be necessary in a mechanism with diagonally crossed cylinders also to provide heavy structural members extending laterally between the spaced pivot mounts on the stationary frame at the rear, substantially in the plane of the cylinders, to bear tension and compression forces. Additionally, laterally extending heavy structural members are conventionally employed in compactor heads having a longitudinally extending hydraulic cylinder, as well. However, it is an aspect of the present disclosure that the rear structure of the stationary frame is free of structural members extending directly between the laterally spaced pivot mounts at the rear of the frame. Instead of structural members extending directly between the lateral sides at the rear of the frame, which obstruct access to and view of the interior of the compactor head, an opening between the frame members is provided at the rear, for access to the cylinder(s) and their hydraulic coupling(s), pivot pin(s), etc. The opening also provides access to the area behind the ram, where material that has somehow bypassed the ram might accumulate. In various instances, a removable access panel covers the rear opening and is easily removable via bolts or the like.

The stationary frame is structured to withstand the tension and compression forces of the cylinders, due to structural members that are disposed around the rear access panel opening, but which do not span across the rear access opening in the plane of the cylinders and their pivot pin mounts. In various instances, the stationary frame can comprise particularly strong horizontal frame members extending between end vertical members or stiles, framing around the rear access opening. For example, the pivot mounts for the cylinders can be located at the corners at the rear of the rectilinear members of the frame, and bracing structures can be disposed outside of the members framing the access opening, for example, extending diagonally relative to the frame members. In one arrangement, the rear frame members are buttressed with diagonal reinforcing members to withstand tension and compression in the plane of the cylinders. In another arrangement, the access opening can have diagonal bracing that extends between points on the framing around the rear access opening. For example, diagonal brace(s) can extend between the horizontal and vertical members of the stationary rear frame. Such diagonal braces can minimize the obstruction of the space between the rear frame elements without use of a direct connection between the cylinder pivot pin mountings at the rear of the stationary frame.

In various instances, lateral side panels and a bottom panel cover the frame members on the inside. These panels define a rectilinear cylinder in which the ram reciprocates like a piston in a cylinder for pushing loaded material into the compressed material container.

The rear opening between the frame members provides access to the ram mechanism in the space between the top and bottom headers and the laterally spaced vertical stiles. The rear opening between the frame members can be accessed by removing the access panel. This arrangement allows service to be effected on the cylinders and on the area to the rear of the ram. Additionally, it can be possible to operate the compactor with the access cover removed in order to inspect the operation of the ram.

In various instances, the ram comprises at least a face plate and two side plates defining a piston that complements the cross sectional area of the charge box through which the ram moves. Instead of providing a fixed top plate on the ram, a sliding top cover, preferably comprising plural telescoping segments that overlap, for example, can engage the top of the ram face plate. In such instances, the sliding top cover becomes elongated forward to cover over an area behind the face plate when the ram is advanced, and is collapsed rearwardly when the ram is retracted such that the segments are brought back into an overlapping arrangement at the rear of the frame, compactly stowing the ram and the cover plate at the rear of the frame, for example, in front of the diagonally folded back hydraulic cylinders.

The area of the rear access opening, which is exposed by removing the access plate, is preferably maximized by structuring the rear members of the frame using steel plate stock for the vertical and horizontal members at the rear of the frame. The plate stock is thinner than rectangular tubing as used for other frame members. The added space made available in front of the plate stock is used at the bottom-rear header of the frame for placement of the fixed piping of a hydraulic manifold (and connection points for flexible hydraulic connection lines coupling to the cylinders). The space made available in front of the plate stock used at the top-rear header is occupied by the telescoping panels of the collapsible top cover assembly. Thus, a large part of the space behind the ram piston is used for necessary contingencies and the ram itself retracts into a minimal space.

In various instances, to provide sufficient structural support at the rear of the frame without using rectangular tubing, additional plate stock is welded inside the side panels to carry the pivoting end couplings for the hydraulic cylinders, and outside the side panels along gussets with inclined plates welded between the rear framing plate and the side panel, and between the upper and lower side frame elements, made of rectangular tubing. This provides for a rear frame structure that is even more stiff and durable than would be possible using rectangular tubing for the upper and lower horizontal members (the rear headers) of the frame.

In a roll-on embodiment, additional reinforcement can be provided at the rear by a bottom chassis configured with heavy steel rollers and guides that carry the self-contained compactor unit along the tilting bed of a roll-off truck. The additional enforcement can include inclined buttress supports extending from the bottom chassis to the vertical rear frame members.

It is an object to arrange these structures in a manner that makes the ram and ram drive structure very compact in the direction of ram movement, while also providing a generous charge box length. For example, the ram may not only be stowed in a short depth when fully retracted, but may also have a long advance/retract stroke that begins from a point in which the hydraulic cylinders are folded to a high angle nearly perpendicular to the longitudinal ram stroke direction, for example.

A longitudinally short ram piston and a deeply diagonally folded hydraulic cylinder orientation might raise the risk of racking of the ram piston and associated wear and flexing. The tendency to rack is reduced in some embodiments by the manner in which the ram piston is carried on the longitudinal guide rails that face inwardly from the side wall panels mounted on the inside of the frame. In particular, the ram piston can be provided with riders having shoes that are channel shaped and complementary to the guide rails. The riders can be located out in front of the face of the ram piston at the front side and extend from the rear of the ram piston side members at the rear of the ram, for example. Thus, the length between supporting points on the guide rails is longer than the depth of the ram piston in the advance/retract direction. The front sliding shoes at the corners reside at the end of the rails in a fully advanced position of the ram and the rear sliding shoes are at rear ends of the rails adjacent to the rear opening at a fully retracted position of the ram. This technique elongates the piston support structure and reduces the tendency of the piston to rack, without elongating the ram piston itself, but with the riders on the guide rails protruding out in front of the ram pusher plate as well as to the rear of the ram pusher plate.

The extending riders at the front extend into the charging box when the ram piston is retracted. But the riders do not substantially enlarge the structure that already occupies the charging box in that state, namely the guide rails. When the ram is fully extended, the riders at the front reach the end of the guide rails and the end of the charging box side panels, for example. To achieve this, the guide rails extend into the compaction container by approximately 18 inches, for example, whereas the front face of the fully extended ram piston extends perhaps 6 or 7 inches, for example, into the compaction container.

Additional reinforcing structures include at least an upper header or cross member that is raised vertically upward at the front of the frame. The raised upper header engages behind the wall of the compaction container adjacent the inlet opening into the compaction container. Such engagement from inside the compaction container provides a hold against which the force of the ram is opposed when pressing material into the container. The engagement prevents the compactor head from seeking to push itself away from the compaction container due to the force of the ram.

At the rear, the extending riders occupy a space that is clear of the hydraulic pistons and abutment of the riders against the rear frame can define the point at which the ram has reached its maximum retraction.

Turning to the Drawings, wherein like numerals denote like components throughout the several views, a self-contained compactor is depicted in FIG. 1. The self-contained compactor can comprise a compactor head 30 attached to a compressed material container 32 (FIG. 1). The container 32 depicted in FIG. 1 has an opening at the lower right end, to which the compactor head 30 engages. Material to be packed into the container 32 is loaded vertically into a charge box or hopper 33. A ram assembly 80, see, e.g., FIGS. 5-10, is normally retracted against the rear end 35 of the compactor head 30, and during compaction cycles, i.e., an advancement or compaction stroke and a retraction stroke, is advanced to the left (as oriented in FIG. 1) so as to push material from the hopper 33 of the compactor head 30 into the container 32. The self-contained compactor unit 30, 32 is shown without an optional, associated chute, dog-house cover, and/or dumping mechanism, for example, into and/or leading toward the opening in the hopper 33 of the charge box; however, the reader will appreciate that the self-contained compactor unit 30, 32 can be configured to include various different feeding chutes, doors, covers, and/or dumping mechanisms, for example.

Referring primarily to FIG. 1, the end of the container 32 opposite from the compactor head 30 has a door 36, which can be opened when the container 32 is to be emptied. The assembly of the compactor head 30 and the container 32 is detachable from a hydraulic power unit (not shown) and can be transported over the road (or by rail or other methods, for example) to a disposal site. The self-contained compactor embodiment shown in FIGS. 1-23 is configured as a unitary structure to be carried as a unit on a roll-off chassis (see, e.g., FIGS. 1, 17, and 18). Accordingly, the container 32 and the compactor head 30 are mounted together on longitudinal bottom rails 37 (FIG. 1) with end rollers 38 (FIGS. 1, 17, and 18). In various instances, a hook-receiving structure 96 (FIG. 17) is located on the underside of the compactor head 30 and can be engaged by the cable winch of a roll-off truck (not shown). For example, the unitary compactor head 30 and the container 32 can be pulled up onto the tilted bed of the roll-off truck in a known manner. In various instances, the truck can transport the compactor-container unit 30, 32 to a disposal facility or site. The door 36 of the container 32 can then be disengaged and the unit 30, 32 can be tilted up at the compactor head 30 rear end 35 to dump the container 32 contents through the door 36, for example.

There are a number of variations possible in connection with the combinations of the compactor head 30 and the container 32 depicted in FIGS. 1-23. In other words, the embodiment of the unitary self-contained compactor unit 30, 32 with roll-off structures is an apt but non-limiting example of various configurations that can use the disclosed compactor head 30, which is shown separate from the container 32, in FIGS. 2-16 and 19-23. For example, it is conceivable to removably affix the compactor head 30 to a different container or to a different apparatus entirely, such as to a material feed path of a waste handling plant, for example.

Referring still to FIGS. 1-23, the compactor head 30 comprises sidewalls or sidewall panels 42 and a bottom wall or panel 43 defining a framed box or receptacle that includes the area of the hopper 33, which is shown, for example, as an open-topped box. The receptacle can be framed by vertically-spaced side supports 44, for example, of rectangular tubing, two of which can extend longitudinally along the laterally opposite side walls 42 of the compactor head 30. In various instances, the sidewall panels 42 are attached on the inside of the longitudinal side supports 44. Likewise, the bottom panel 43 is attached on the inside of the longitudinal bottom supports 99, which are disposed under the bottom panel 43, for example.

Referring still to FIGS. 1-23, the compactor head 30 is open at the front end facing toward the container 32 (FIG. 1). A ram structure or ram assembly 80 retracts into the rear portion of the compactor head 30 at rear end 35, and extends through the hopper 33 to push material into the container 32. The pushing face plate or leading face 45, see, e.g. FIG. 2, of the ram assembly 80 occupies substantially the full cross sectional area of the hopper 33 and sweeps the hopper 33 empty during a ram-advance stroke in which the ram's furthest advance can be approximately six or seven inches, for example, beyond the wall of container 32. In various instances, an advance of the leading face 45 beyond the surface of the container wall is useful to reduce the tendency of compressed material to expand backwards into the hopper 33, for example, when the ram assembly 80 is retracted after a compaction stroke.

Figure 2:
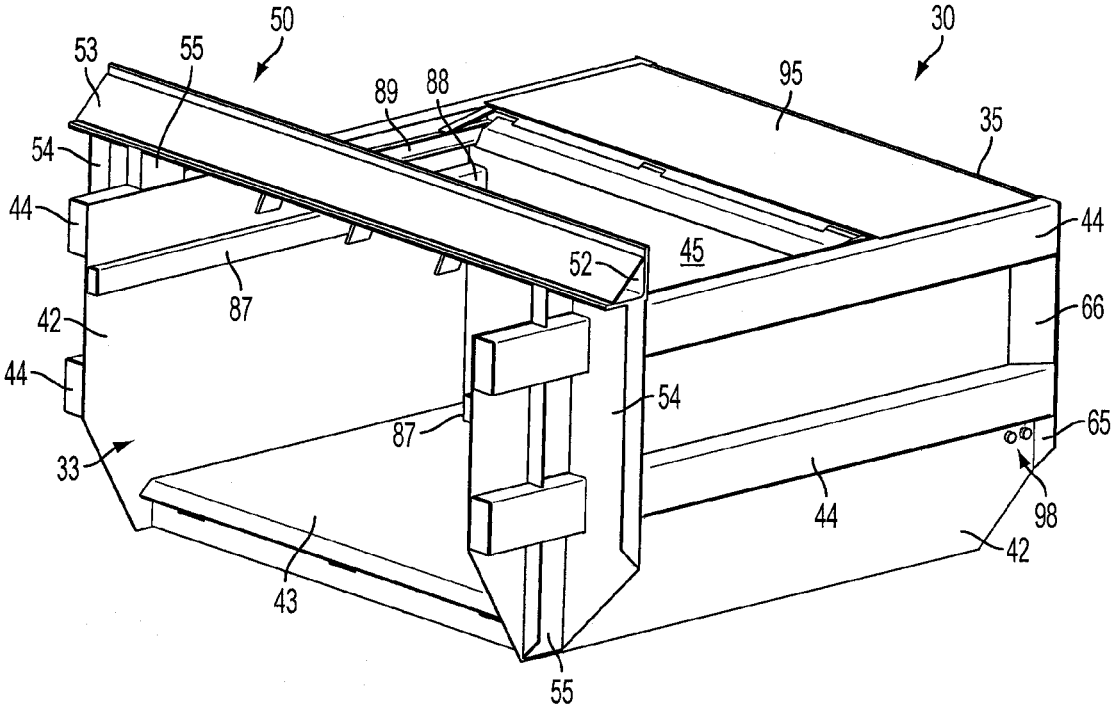
FIG. 2 is a front perspective view of the compactor head of FIG. 1, wherein the ram assembly of the compactor head is depicted in a fully retracted position, according to various embodiments of the present disclosure.
Figure 3:
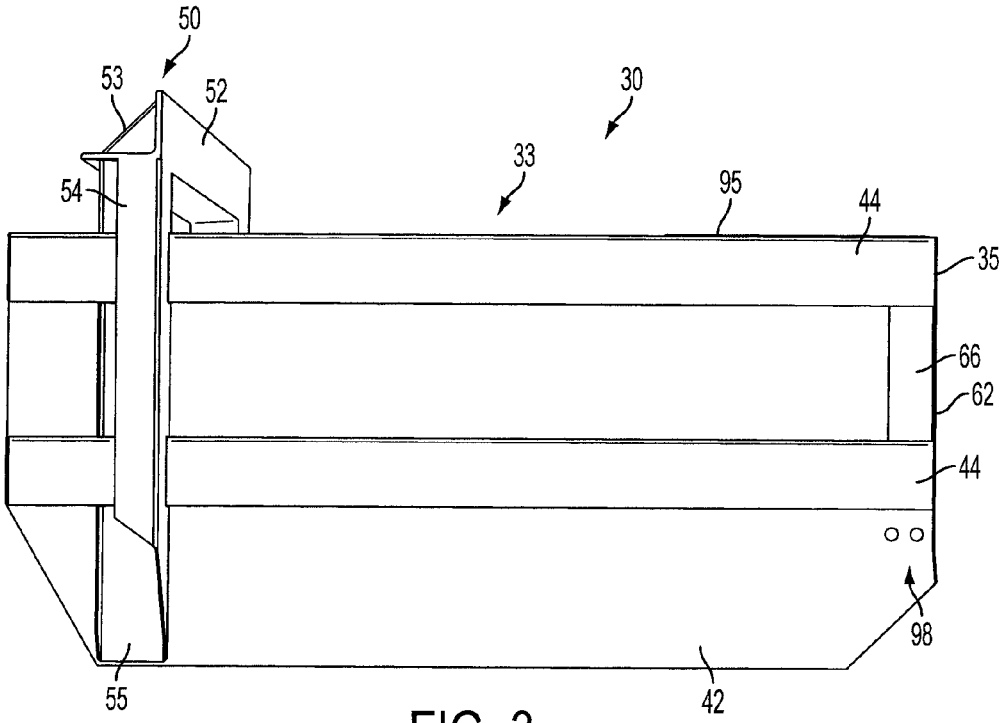
FIG. 3 is a side elevation view of the compactor head of FIG. 1, according to various embodiments of the present disclosure.

In various instances, the longitudinal side supports 44 are attached to the sidewall panels 42 and extend longitudinally beyond a container-side engagement structure 50, which comprises an engagement header 52, two lateral flanges 54 and two vertical stiles 55, for example, which can be formed by sections of angle iron welded to and between the horizontal (longitudinal) side supports 44, also shown in the side view of FIG. 3, for example. The engagement structure 50 can be disposed inside the opening of container 32 (FIG. 1) and, therefore, is not visible in FIG. 1. For example, the rear-facing surfaces of the header 52 and the flanges 54 can reside inside the container 32 around the opening. Thus, when the ram assembly 80 presses material into the container 32, the engagement structure 50 (header 52 and/or flanges 54), supported by the vertical stiles 55, can provide a robust structure inside the container 32 that resists the resulting force that might cause the force of the compactor ram assembly 80 to push the compactor head 30 away from the container 32. As shown in FIG. 2, in various embodiments, the engagement header 52 can comprise an angle iron bar to which a reinforcing gusset plate 53 is welded for further strength and stiffness.

Figure 4:
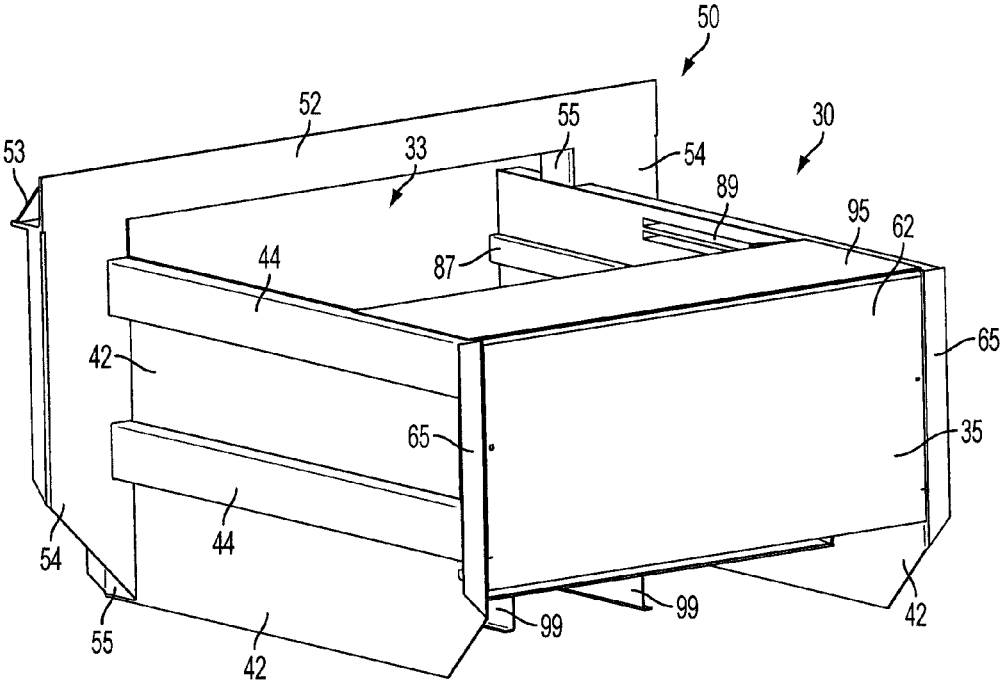
FIG. 4 is a rear perspective view of the compactor head of FIG. 1, according to various embodiments of the present disclosure.

The rear end 35 of the compactor head 30 supports the mounting of a drive assembly 70, which can include hydraulic cylinders 72, for example, which drive the ram assembly 80 forward and backward during a compression stroke. FIGS. 3 and 4 show the rear structures externally and depict the rear access cover 62, for example. In FIGS. 5-10, 16, 17, 20, 22, and 23, the access cover 62 has been removed from the compactor head 30 for illustrative purposes and various details of the structure and operation of the ram assembly 80 and pusher panel 82 are shown.

The structure of the rear end 35 of the compactor head 30 is configured for efficient use of space, while at the same time maximizing the clearance for access to the ram assembly 80 and drive assembly 70 from the rear of the compactor head 30 by removing a simple access cover, such as cover 62 (FIGS. 3, 4, and 11), which can be bolted onto the framing members 63, 64 that define the rear frame structure or brace 60. In the embodiment depicted in FIGS. 1-23, two vertical frame members 63 and two horizontal frame members 64, shown in FIGS. 5 and 6, for example, define a box-shaped rear access opening 61. These frame members 63, 64 can comprise angle iron bars, or L-shaped beams, for example, having their metal surfaces aligned to the rear end 35 and to the top or bottom of the compactor head 30 (for horizontal frame members 64), and/or to the rear end 35 and to the lateral sides of the compactor head 30 (for vertical frame members 63). By using angle iron members for these positions, the frame members 63, 64 do not reduce the inside volume of available space for the hydraulic cylinders 72 and associated mechanical and hydraulic fittings. In various instances, the rear frame or brace 60 can further include corner braces 91, for example. The frame 60, including the members 63, 64, and/or 91, for example, can negate or absorb the lateral forces (perpendicular to the sidewalls 42, for example) generated by the hydraulic cylinders 72. As a result, the frame 60 can eliminate the need for a laterally extending structural member between the sidewalls 42 and/or cylinders 72, for example. Moreover, the continuous opening defined by the frame 60, i.e., without a bisecting structural member, can provide unobstructed access into the interior or body of the compactor head 30.

Referring still to FIGS. 1-23, the rear frame members 63, 64 are reinforced internally in the area at which the hydraulic cylinders 72 pivotably attach to the frame members 63, 64, and can also be reinforced externally, for example. Additionally, the rear frame 60 does not include a structural member between the frame members 63, 64 that connects directly between the pivot pin mounts 74 for the hydraulic cylinders 72, for example, which would occupy the plane of the cylinders 72 across the opening 61 in the rear frame 60 comprising members 63, 64. At the opposite ends of the cylinders 72, the ram pusher plate 82 and the associated lateral reinforcing bars 83 on the back of the ram pusher plate 82 provide members that bear tension and compression from the diagonally crossed hydraulic cylinders 72. At the rear frame 60, however, structures surrounding frame members 63, 64 provide the reinforcement, thus keeping the continuous access opening 61 unimpeded and unobstructed (when the access cover 62 is detached).

Figure 19:
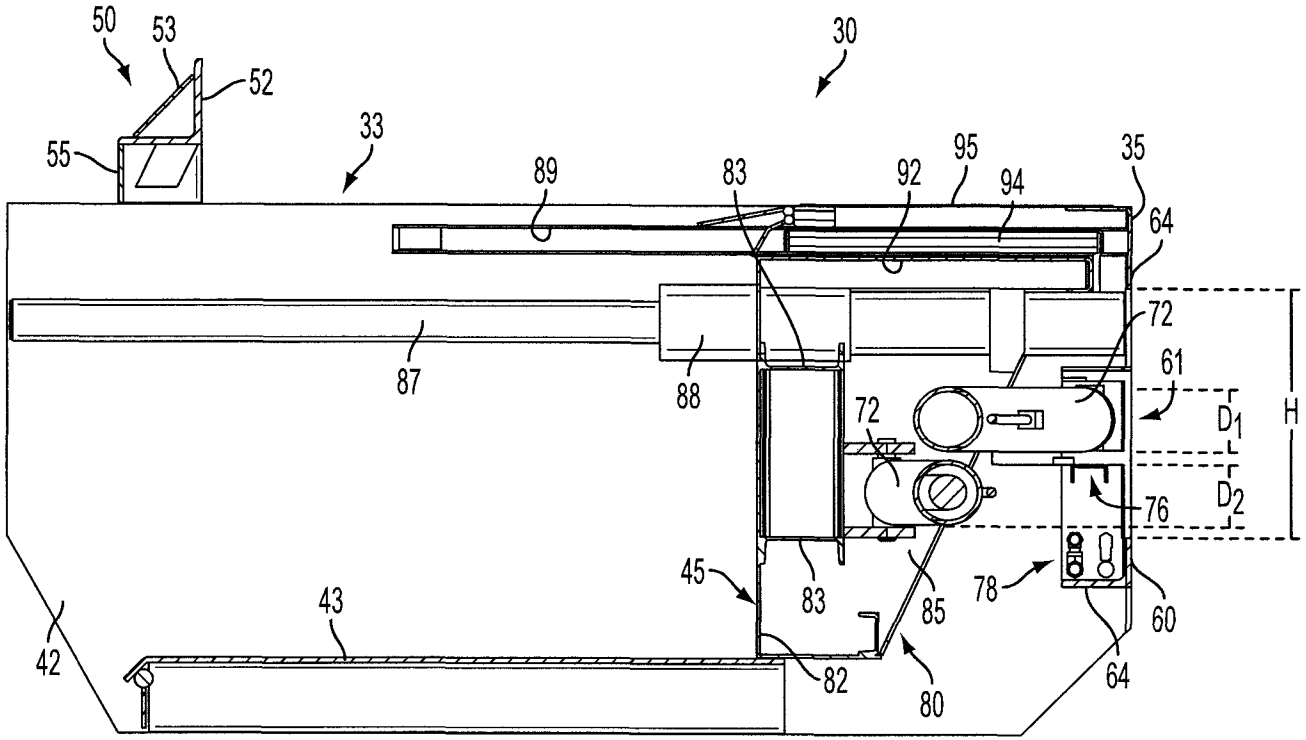
FIG. 19 is a side elevation cross-sectional view of the compactor head of FIG. 1 taken along the plane indicated in FIG. 15, according to various embodiments of the present disclosure.
Figure 20:
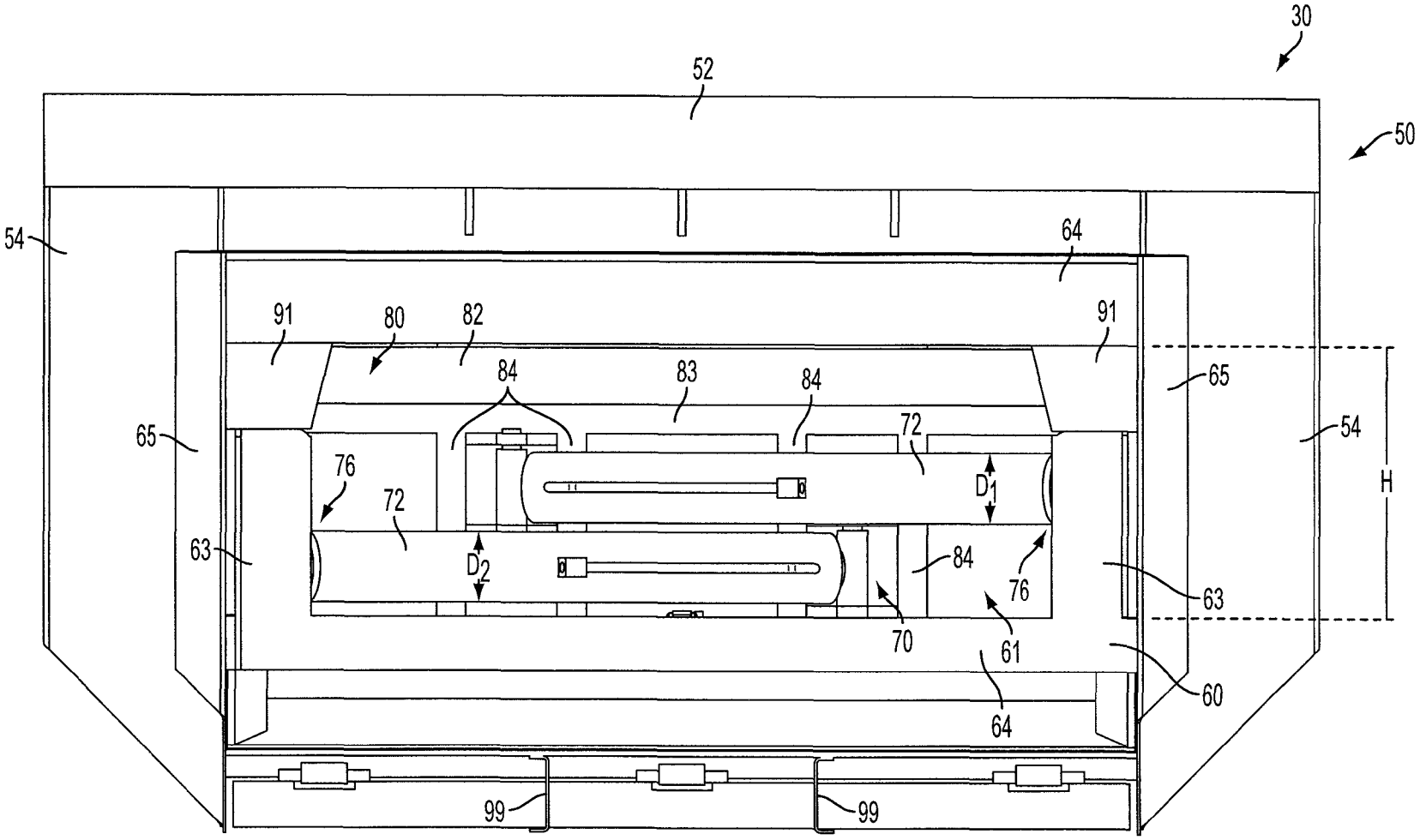
FIG. 20 is a rear end elevation view of the compactor head of FIG. 1, with the access cover removed for illustrative purposes, according to various embodiments of the present disclosure.
Figure 21:
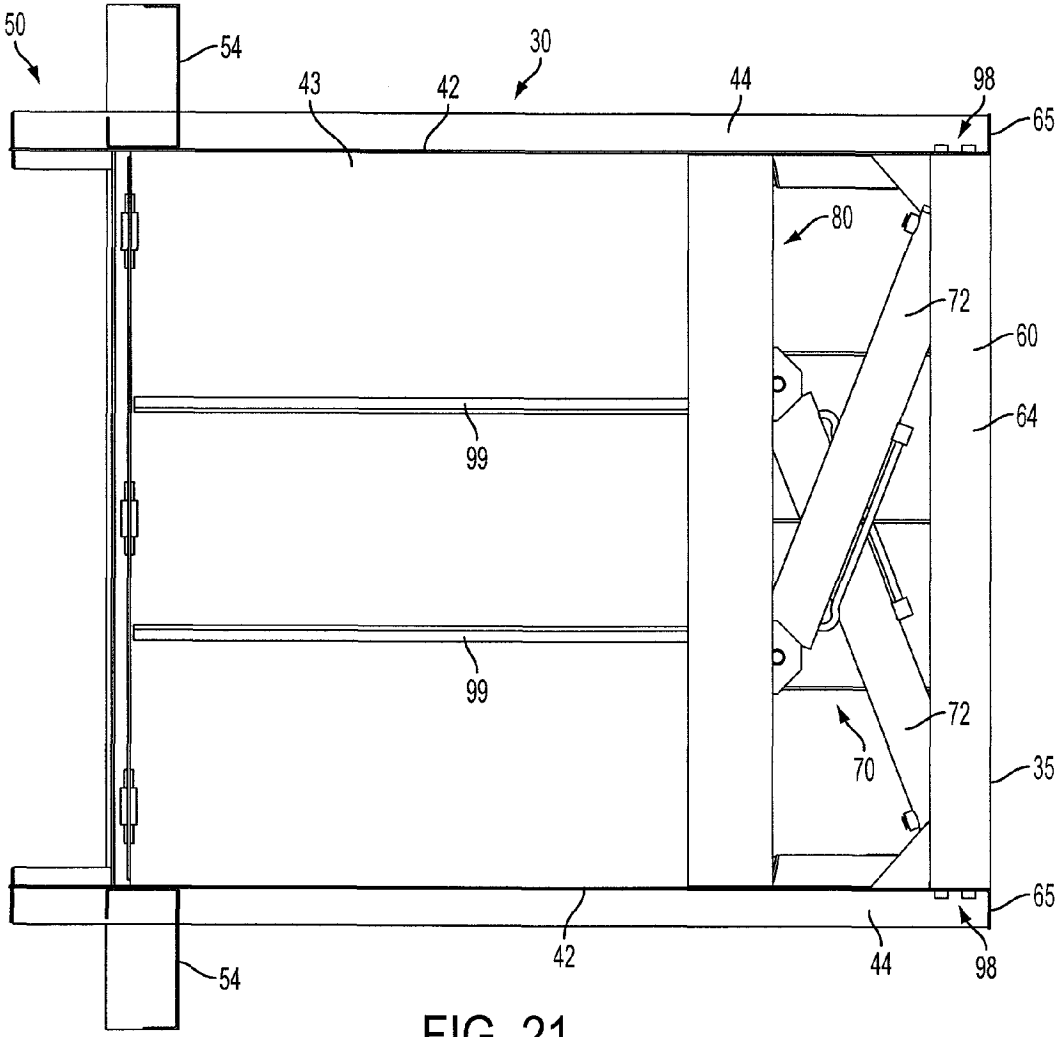
FIG. 21 is a bottom plan view of the compactor head of FIG. 1, according to various embodiments of the present disclosure.
Figure 22:
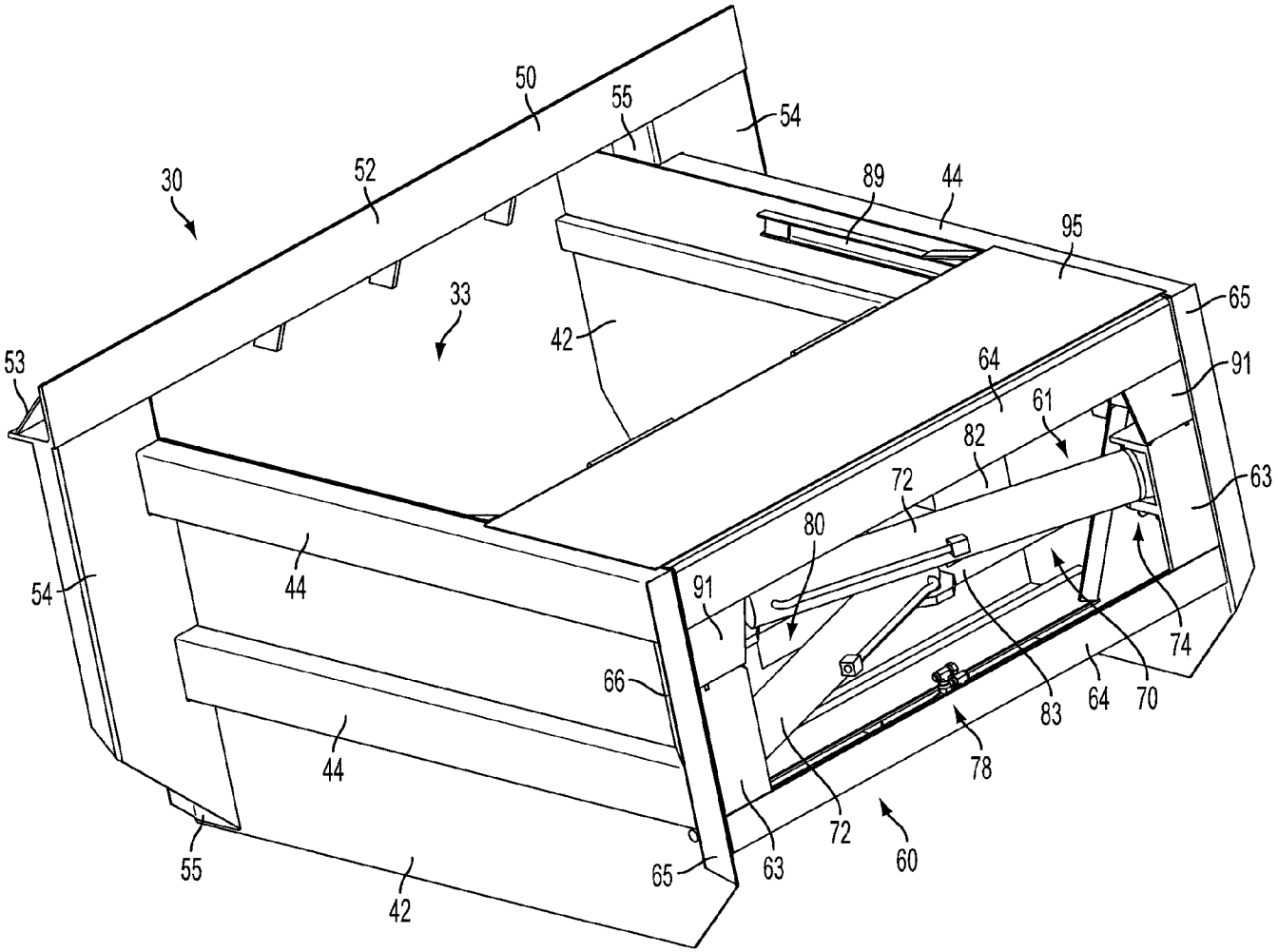
FIG. 22 is rear perspective view of the compactor head of FIG. 1, with the access cover removed for illustrative purposes, according to various embodiments of the present disclosure.
Figure 23:
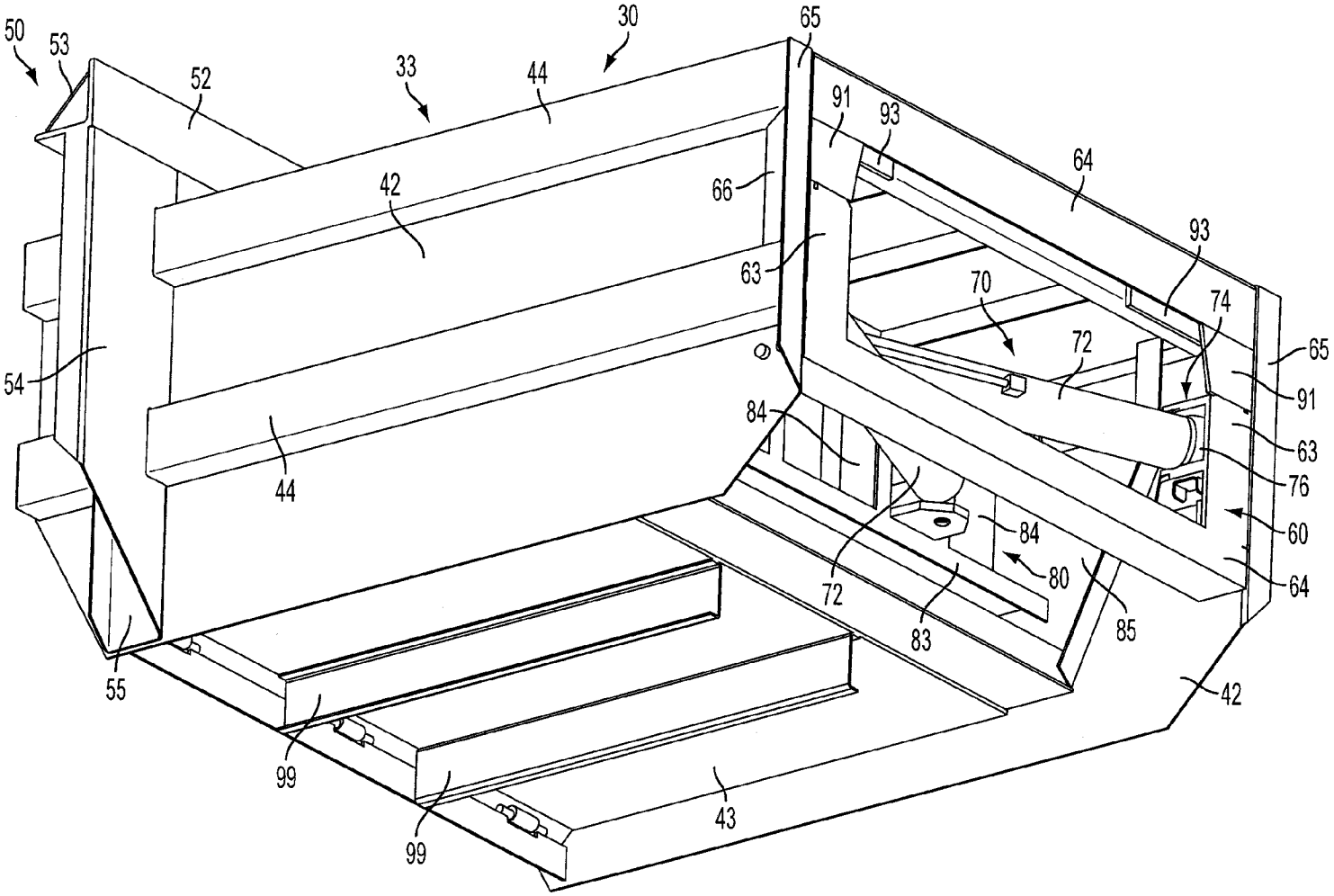
FIG. 23 is another rear perspective view of the compactor head of FIG. 1, with the access cover removed for illustrative purposes, according to various embodiments of the present disclosure.

In various instances, referring primarily to FIGS. 19 and 20, for example, the continuous opening 61 can define a length or height H between the longitudinal upper and lower support members 64. Moreover, the cylinders 72 can each define a diameter. In certain instances, the height H of the continuous opening 61 can be at least 190% the sum of the diameters $D_1$ and $D_2$ of the two cylinders 72. For example, if the cylinders 72 each comprise a diameter of 4⅝ inches, the continuous opening can be at least 17 9/16 inches. In other instances, the height H of the continuous opening 61 can be greater than 150% and less than 200% the sum of the diameters $D_1$ and $D_2$ of the two cylinders 72 and, in other embodiments, can be greater than 125% and less than 250% the sum of the diameters $D_1$ and $D_2$ of the two cylinders 72. In still embodiments, the height H of the continuous opening 61 can be greater than 250% the sum of the diameters D1 and D2 of the two cylinders 72.

There are a number of ways in which the rear frame 60 defined by members 63, 64 can be arranged to bear the tension and compression of the cylinders 72 without employing a connecting member between pivot pin mounts 74 in the plane of the cylinders 72 and crossing or bisecting the continuous, unobstructed access opening 61 defined in the stationary rear frame 60. One alternative is to make the horizontal and vertical frame members 63, 64 particularly strong, for example, to use solid heavy gage angle iron stock. Another alternative is to brace the corners between the frame members with diagonal bracing. For example, diagonal bracing is placed outside the frame members 63, 64 in the embodiment shown, namely including the buttress member, or diagonal brace, 97 shown in FIG. 18. Diagonal bracing members, such as braces 91 (FIGS. 20, 22, and 23) can also be placed on the inside corners between the frame members 63, 64, so that the continuous access opening 61 is diamond shaped, for example.

Figure 5:
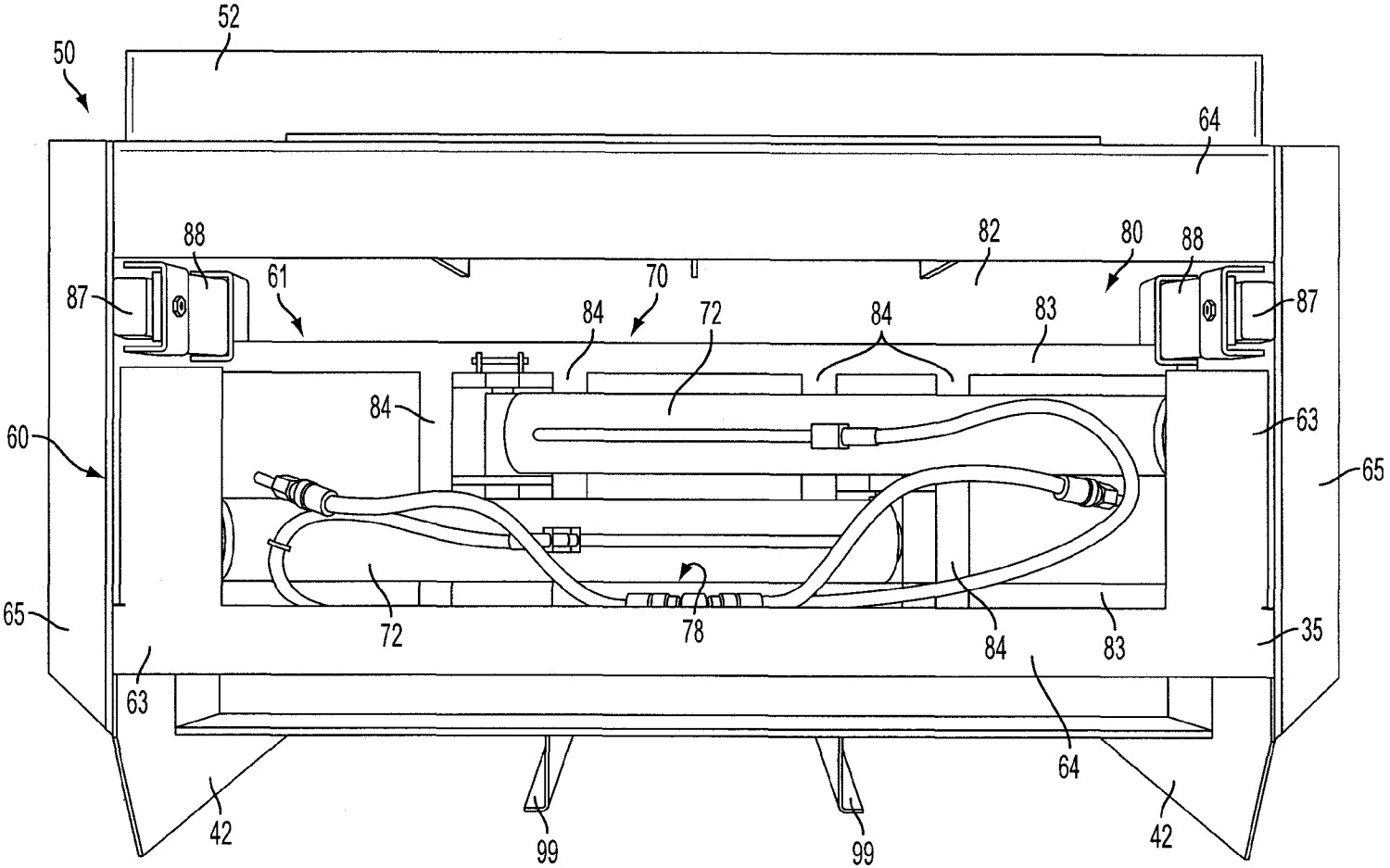
FIG. 5 is an rear end elevation view of the compactor head of FIG. 1, with various elements removed therefrom, including the access panel and a portion of the rear frame, to show the ram assembly and the drive cylinders of the drive assembly within the body of the compactor head, according to various embodiments of the present disclosure.

Referring to FIGS. 4 and 5, the sidewalls 42 can include flanges 65 directed laterally outwardly, and, as seen in FIGS. 2 and 3, for example, a gusset plate 66 can be placed diagonally in the right angle at which the side plate 42 meets the associated flange 65 to reinforce and stiffen the vertical frame member 63 at the rear end 35 of the compactor head 30. These aspects also reinforce the vertical frame member 63 against tension and compression forces in the plane of the cylinders 72, which are particularly applicable when the cylinders 72 are retracted and deeply diagonally folded, for example, such that a large force component is oriented laterally of the direction of advance and retraction of the ram assembly 80.

In various instances, the access panel or cover 62 bolts to the vertical and horizontal frame members 63, 64 at the rear end 35 of the compactor head 30. It is an aspect of this configuration that two hydraulic cylinders 72 for driving the ram assembly 80 can be mounted at pivot fittings 74 located at the extreme rear corners, and the associated mechanisms such as the pivot pins 76 (FIG. 16) at which the cylinders 72 are mounted, can be easily accessible by removing the rear access panel 62.

Figure 6:
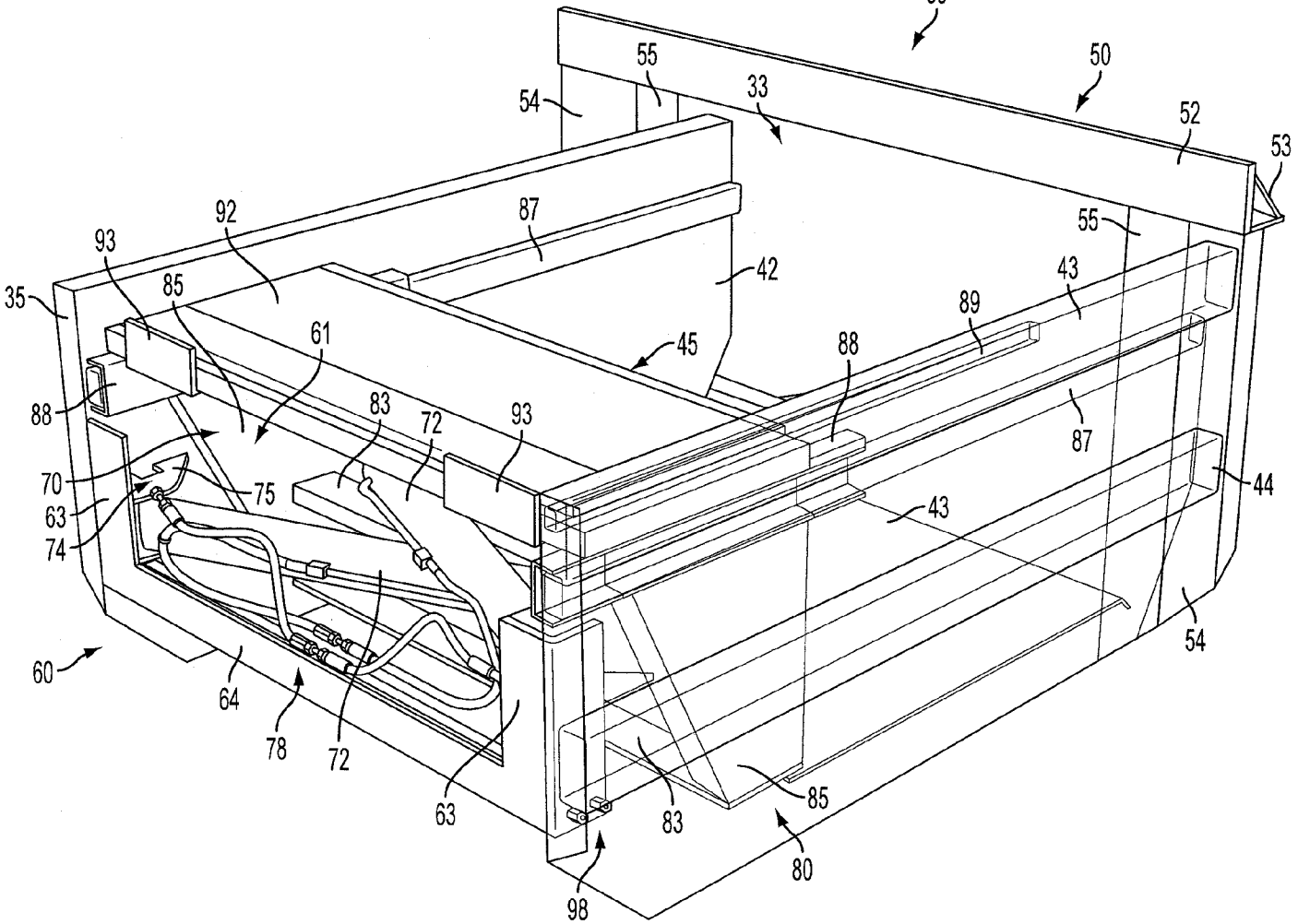
FIG. 6 is a rear perspective view of the compactor head of FIG. 1, with various elements removed therefrom, including the fixed top cover panel and a portion of the rear frame, and with various elements shown in transparency, including one lateral side of the compactor head, to show the structure of various frame members, the ram assembly and the bottom plate of the compactor head, and further depicting the ram assembly fully retracted, according to various embodiments of the present disclosure.

In the arrangement shown in FIGS. 5 and 6, the hydraulic cylinders 72 are diagonally crossed, each coupled between vertically aligned pivot pins 76 (FIG. 16) mounted between welded flanges respectively at an angle iron frame member in the rear corner of the fixed frame 60, and between the reinforcing bars 83, 84 on the backside of the ram pusher panel 82. These pivot pins 76 are accessible through the rear opening between the vertically and horizontally spaced fixed frame members 63, 64 of the rear frame 60.

In various instances, the movable ram assembly or carriage 80 comprises the ram face plate or pusher plate 82 that defines the rear leading face 45 of the charging box 33. The pusher plate 82 and the rear face 45 are carried across the charging box 33 when the ram carriage 80 is advanced. The ram face plate 82 is backed by one or more laterally and vertically extending reinforcing bars 83, 84, for example, comprising rectangular tubing as shown in FIGS. 5, 8, 16, and 20, for example. In the depicted embodiment, the ram carriage assembly 80 has end panels 85 (shown in FIG. 6) that are trapezoidal, wherein the ram carriage assembly 80 is carried along supporting guide bars 87, facing inwardly from the charging box side panels 42. In certain instances, the trapezoidal end walls 85 are wider near the guiding rail structure 87 at the upper region of the ram carriage 80 and narrower near the bottom. This permits the ram carriage 80 to flex somewhat, for example, if an obstruction is encountered. In other instances, the ram carriage 80 end panels 85 can be rectangular in shape, or wider at the bottom in alternative embodiments (not shown), for example, wherein the ram carriage 80 rides directly against the bottom panel 43 of the charging box 33. In the embodiment shown in FIGS. 1-23, the ram carriage 80 is carried on the guide rails 87.

Figure 15:
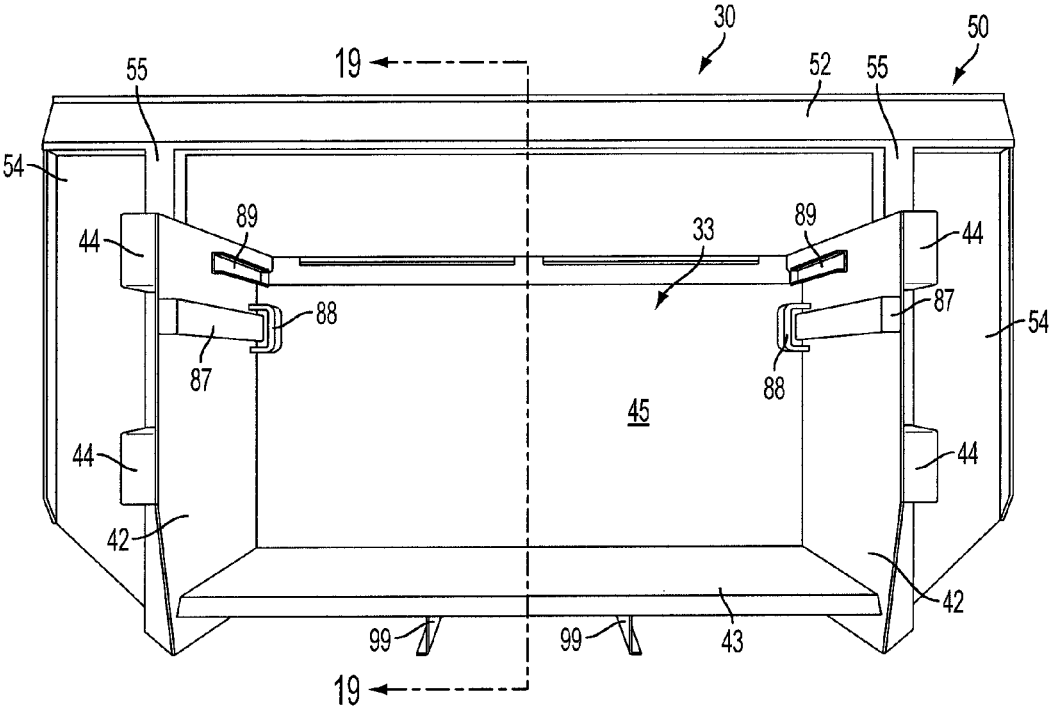
FIG. 15 is a front end elevation view of the compactor head of FIG. 1, according to various embodiments of the present disclosure.

In various instances, movable riders 88 are affixed to the ram carriage 80 and slide along the fixed rails 87 on either side of the ram carriage 80. Referring primarily to FIG. 15, for example, the rails 87 are attached to the side panels 42 and protrude laterally inwardly. Rails 87 are rigidly supported by the vertical stiles 55, lateral flanges 54, vertical frame members 63, and the sidewall flanges 65. The riders 88 can extend along the rails 87 over a distance that is distinctly longer than the depth of the ram carriage 80, for example, between the front of the pusher plate 82 and the rear of the trapezoidal end panel 85. This supports the ram assembly 80 over a distance that is long in the advance/retraction direction and reduces the susceptibility of the ram carriage 80 to racking, for example. However, as a result, the leading side slider fitting 88 (which preferably carries a greased heavy plastic sliding shoe) and the front end of rail 87 extends forward of the ram pusher panel 82 and associated leading face 45 and into the compressed material container 32 (FIG. 1), for example, by about one foot. This aspect is shown in FIG. 15, for example, as if viewed from within the compressed material container 32.

Figure 7:
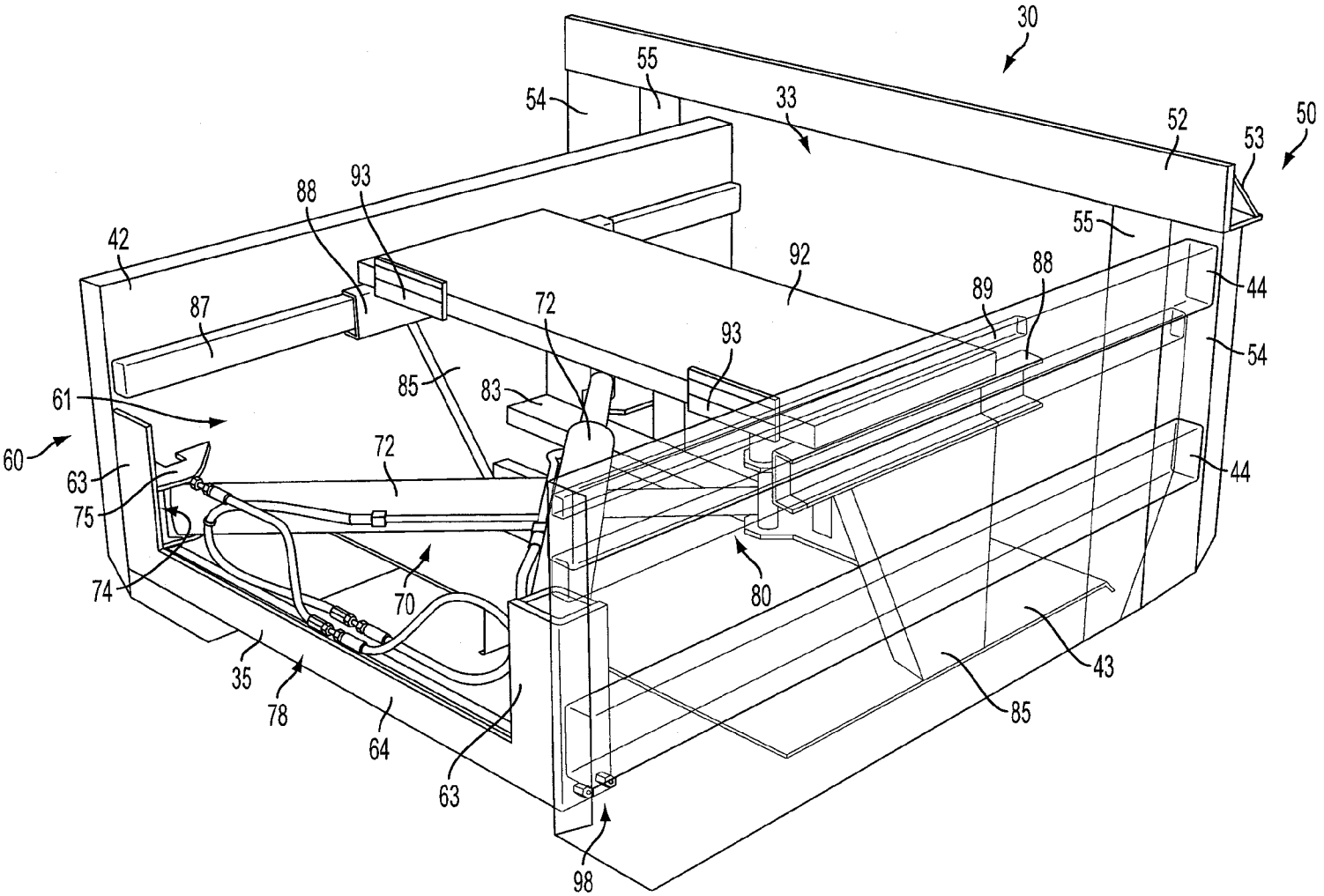
FIG. 7 is a rear perspective view corresponding to the view depicted in FIG. 6, and further depicting the ram assembly near the midpoint of a compaction and/or retraction stroke, according to various embodiments of the present disclosure.
Figure 8:
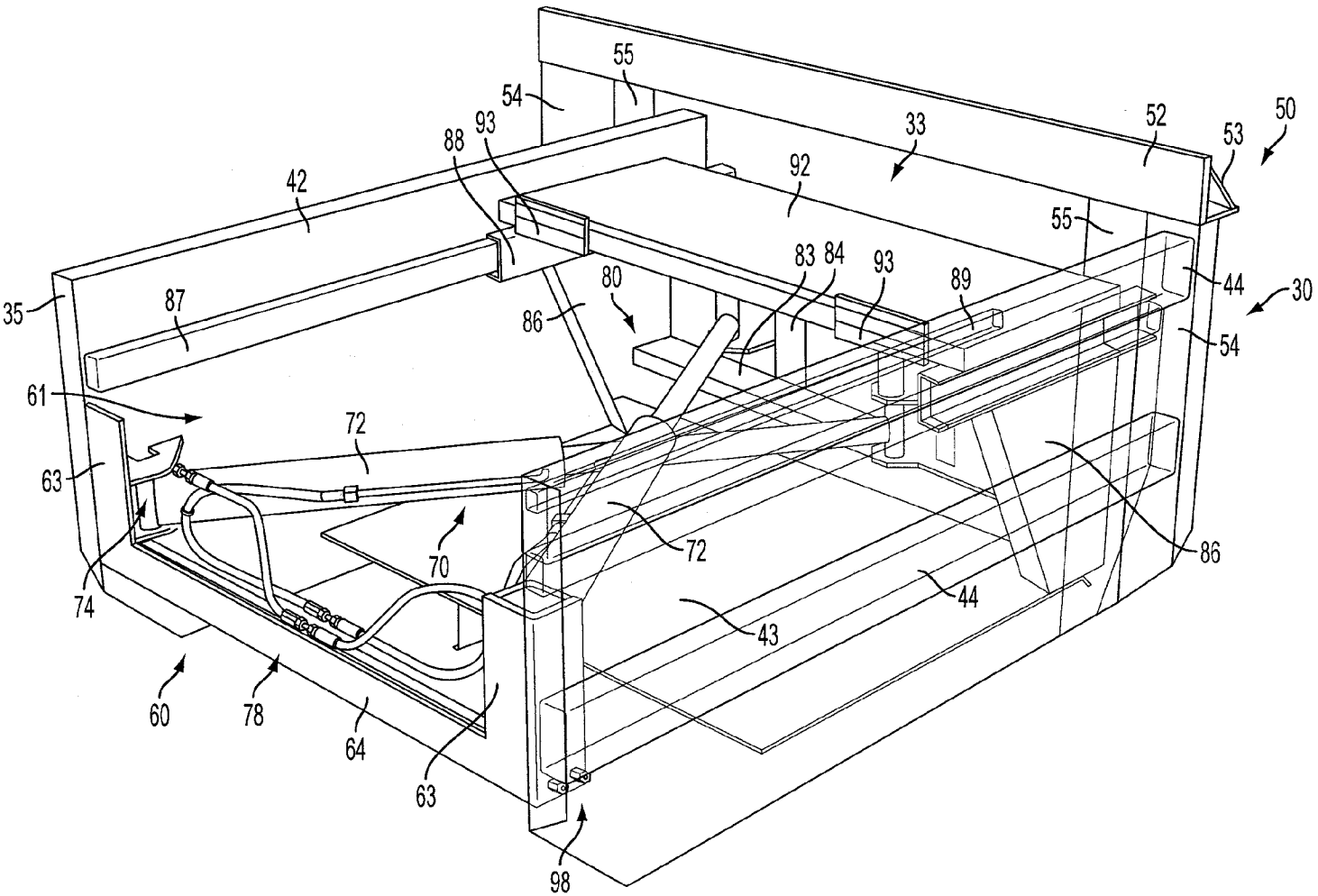
FIG. 8 is a rear perspective view corresponding to the view depicted in FIG. 6, and further depicting the ram assembly near the end of a compaction stroke, i.e., fully extended, according to various embodiments of the present disclosure.
Figure 9:
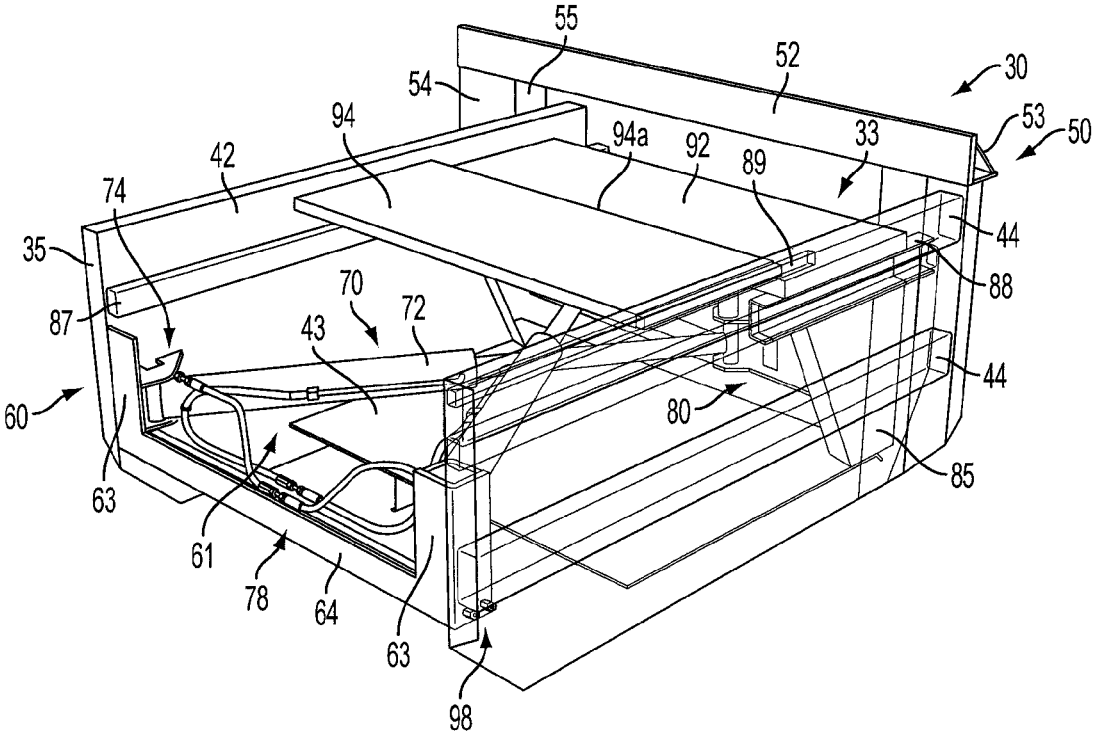
FIG. 9 is a rear perspective view corresponding to the view depicted in FIG. 8, and further depicting a telescoping cover panel and a ram top panel advanced during a compaction cycle, according to various embodiments of the present disclosure.
Figure 10:
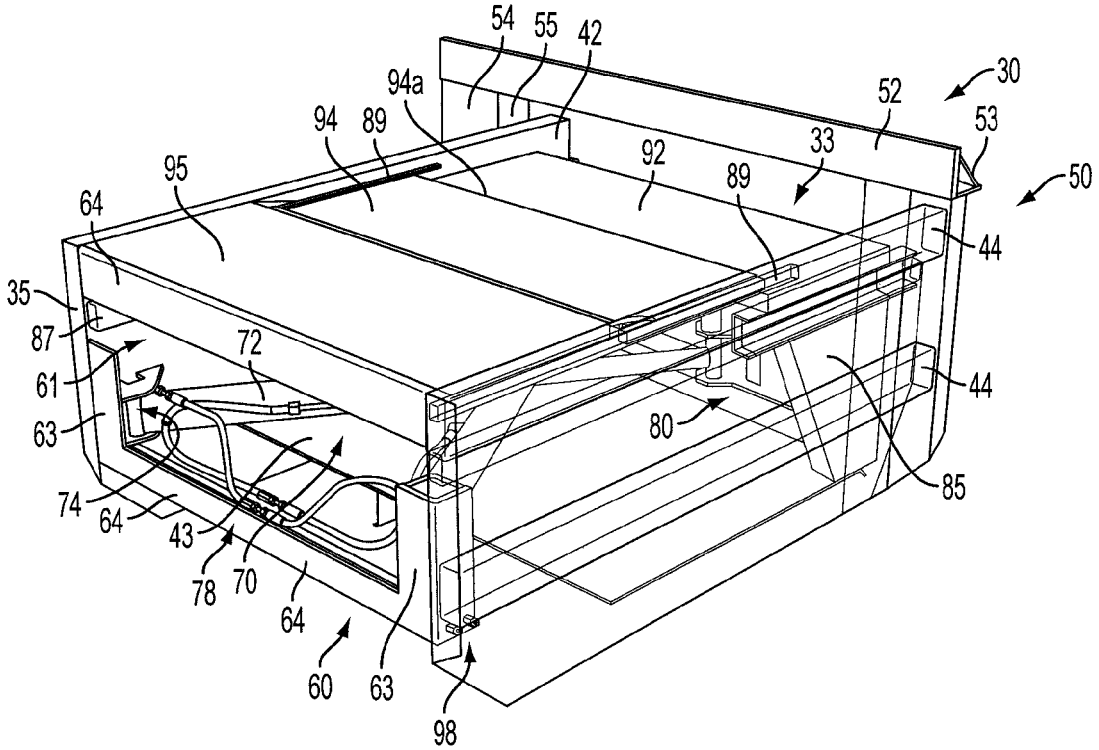
FIG. 10 is a rear perspective view corresponding to the view depicted in FIG. 9, and further depicting a fixed cover panel from which the telescoping cover panel and the ram top panel of FIG. 9 extend, according to various embodiments of the present disclosure.

FIGS. 6-9 show how the diagonally crossed hydraulic cylinders 72 can pivot from their more lateral folded and retracted orientation (FIG. 6), to an intermediate orientation (FIG. 7), to a more longitudinal extended position (FIG. 8). For a given amount of hydraulic cylinder force, the pressure directed longitudinally against the material increases with the extension of the cylinders 72, according to the cosine of the angle of the cylinders 72. This arrangement is efficient because more pressure is exerted near the end of the stroke where compression of the material may provide increased resistance compared to the beginning of the stroke where load compression is just getting under way. The arrangement is also efficient because in the retracted position of the ram assembly 80, the ram drive apparatus, e.g., the pivotable hydraulic cylinders 72, is compactly stowed at the rear end 35 of the compactor head 30.

In FIGS. 7 and 8, which are views of the side and back of the compactor head 30 with various elements removed and others shown in transparency, the ram top panel or cover 92, which is attached to the ram carriage assembly 80, is carried forward with advancement of the ram pusher panel 82. The ram cover 92 can prevent material loaded into the charge box 33 above the ram assembly 80 from falling behind the pusher panel 82 and into the area of the hydraulic cylinders 72. But, in various instances, the ram cover 92 is much narrower in the ram advance/retract direction than the span of the charging box 33. In certain instances, the ram cover 92 has two flanges 93 (FIGS. 7 and 8) that engage behind the front edge 94*a* (FIGS. 9 and 10) of a movable telescoping panel 94, shown in FIGS. 9-12. The telescoping panel 94 can be pulled out from under a fixed top panel 95 at the rear end 35 of the compactor head 30 during advancement of the ram carriage 80, for example, and can be pulled back to reside under the fixed top panel 95 when the ram carriage 80 is retracted, thus uncovering the charging box 33. The telescoping panel 94 can be carried on suitable rolling or sliding structures on the rails 87 or along flanges and/or grooves 89 (see, e.g., FIG. 15) provided at the elevation of the telescoping panel 94, for example.

In various instances, the mechanism of the telescoping panel 94 can fit behind the upper horizontal header frame member 64 at the rear end 35 of the compactor head 30. Referring to FIGS. 17, 19 and 20, for example, the telescoping panel 94 and the ram cover 92 are aligned with, and thus hidden behind, the upper horizontal frame member 64. Likewise, the piping manifold 78 (FIG. 19) and hydraulic connections leading to outside couplings 98 are fit compactly behind the lower horizontal frame member 64. Referring again to FIGS. 17, 19 and 20, for example, the piping manifold 78 extends parallel to the lower horizontal frame member 64, and is hidden within the space defined by the L-shaped, or angle iron, beam. This configuration makes the unit accessible and serviceable through the continuous, unobstructed rear opening 61 simply by removing the access cover 62.

Figure 11:
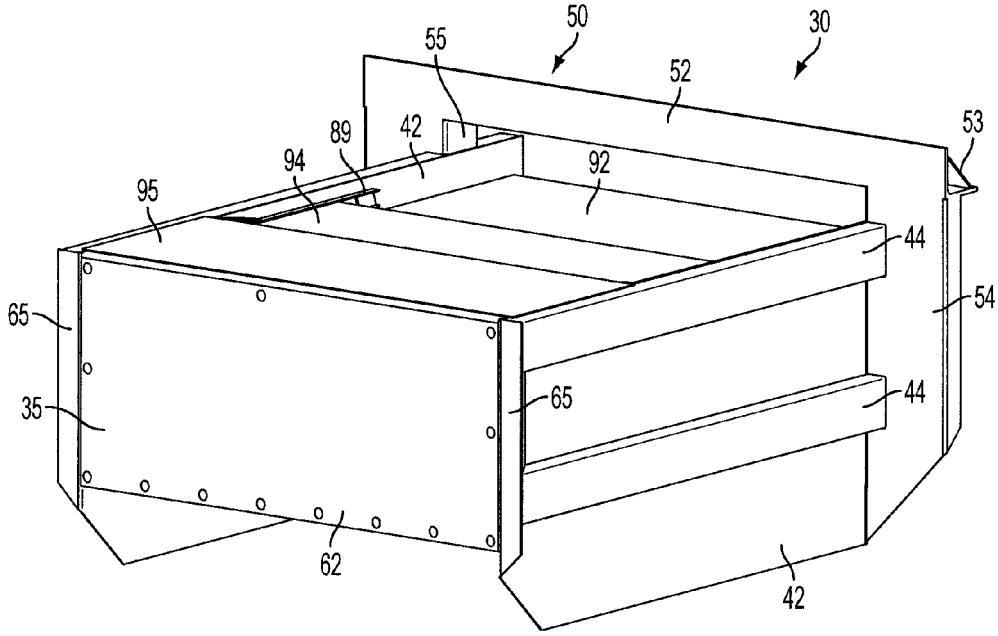
FIG. 11 is a rear perspective view of the compactor head of FIG. 1, depicting the ram assembly at the end of a compaction stroke, i.e., fully extended, and further depicting the telescoping cover panel and the ram top panel of FIG. 9 fully extended, according to various embodiments of the present disclosure.
Figure 12:
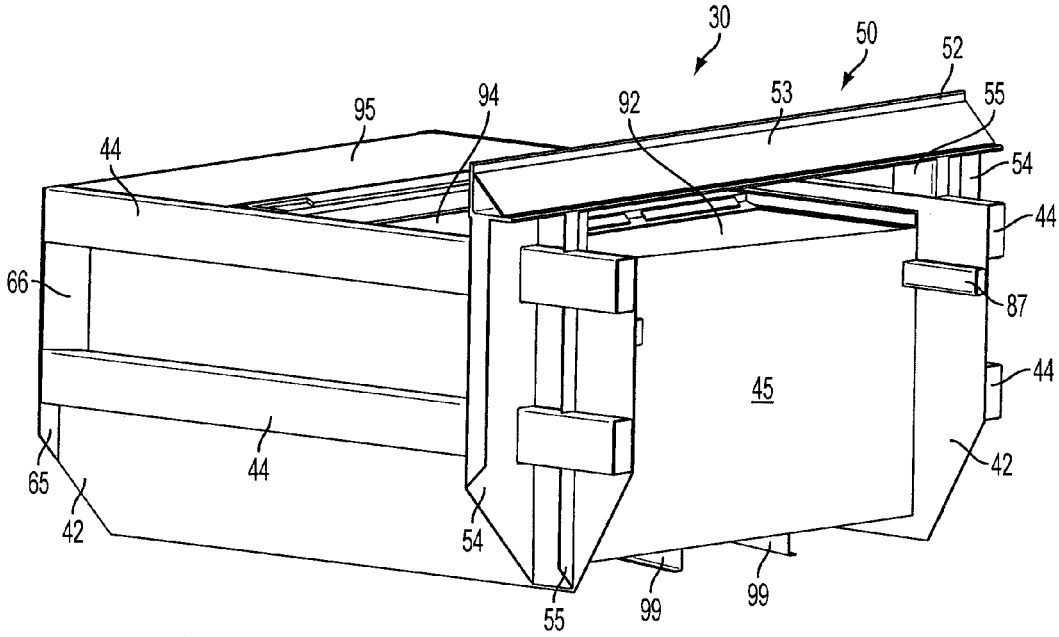
FIG. 12 is a front perspective view of the compactor head of FIG. 1, depicting the ram assembly at the end of a compaction stroke, i.e., fully extended, and further depicting the telescoping cover panel and the ram top panel of FIG. 9 fully extended, according to various embodiments of the present disclosure.
Figure 13:
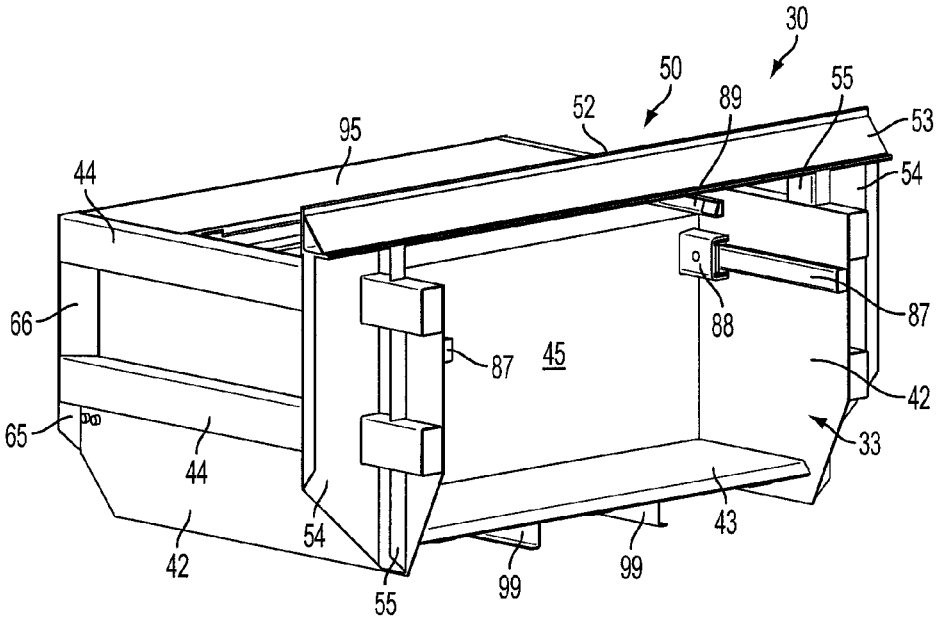
FIG. 13 is a front perspective view of the compactor head of FIG. 1, depicting the ram assembly at an intermediate position during a compaction and/or retraction stroke, and further depicting the ram top panel partially extended and/or partially retracted, according to various embodiments of the present disclosure.
Figure 14:
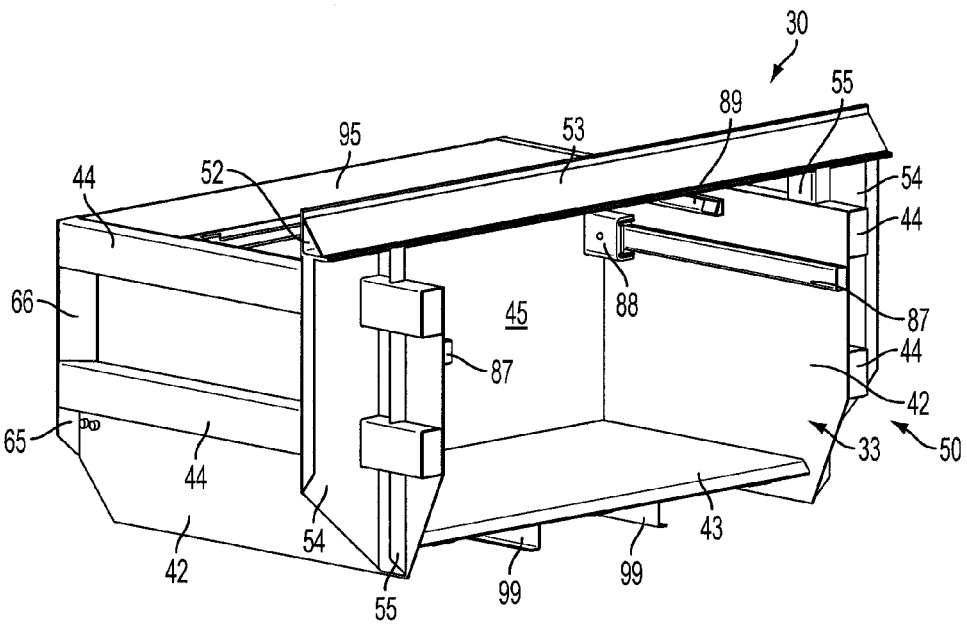
FIG. 14 is a front perspective view of the compactor head of FIG. 1, depicting the ram assembly fully retracted, and further depicting the ram top panel of FIG. 9 fully retracted, according to various embodiments of the present disclosure.

Referring now to FIGS. 11-23, the assembled compactor head 30 including the rear access cover 62, telescoping panel 94 and top panel 95, is depicted, and various, different positions of the ram carriage 80 are shown. For example, FIGS. 11 and 12 show the telescoping cover 94 fully extended and the ram assembly 80 at full advancement or extension. In FIG. 12, the ram pusher plate 45 extends six or seven inches into the container 32 (FIG. 1) because the container wall would be on the opposite side of the engagement structure 50, e.g., the reinforced header member 52 and its associated flanges 54, would be within the container 32. In FIGS. 13-16, two stiffening channels or longitudinal buttress members 99 are shown welded under the bottom panel 43.

Figure 16:
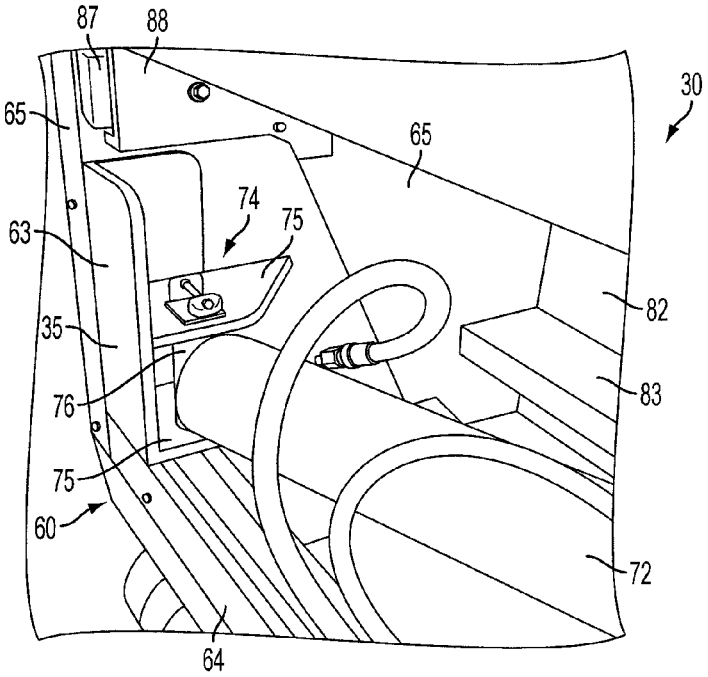
FIG. 16 is a partial rear perspective view of the compactor head of FIG. 1, showing details of the rear frame and the pivot pin mount of one of the hydraulic cylinders of the drive assembly, according to various embodiments of the present disclosure.
Figure 17:
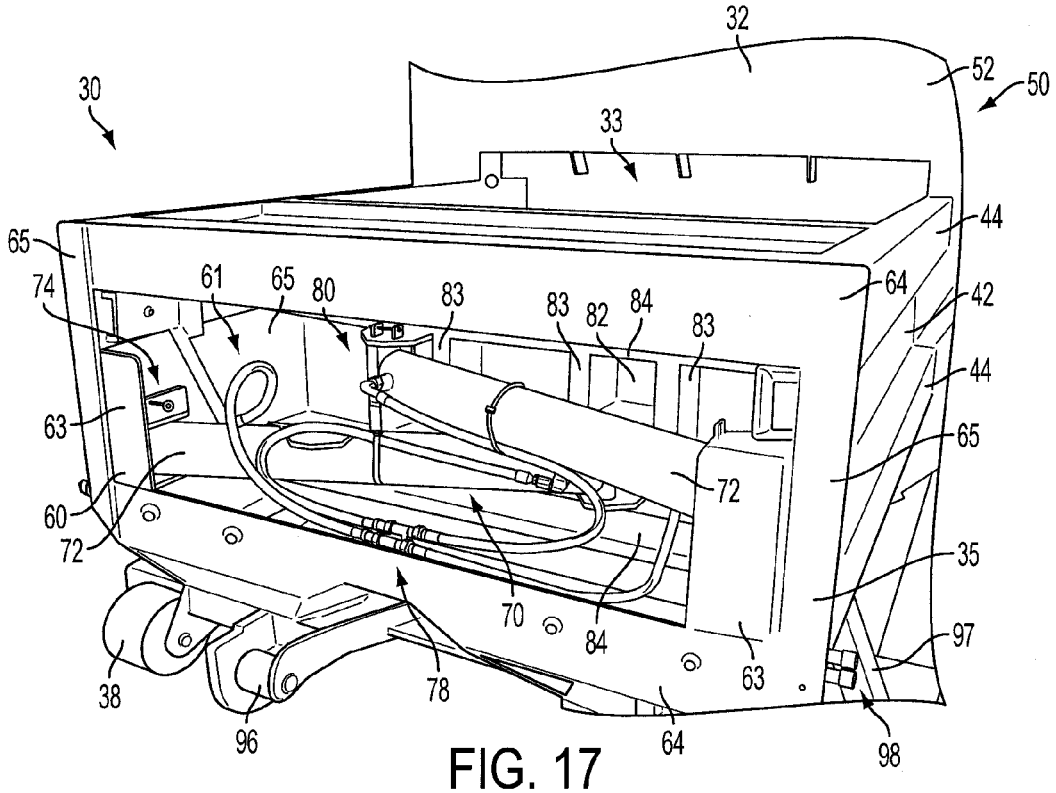
FIG. 17 is a rear perspective view of the compactor head depicted in FIG. 1, showing further details of the rear ram retraction area within the compactor head, and further depicting a roll-off structure comprising rail and roller mountings for configuration of the compactor head as a roll-off unit, according to various embodiments of the present disclosure.
Figure 18:
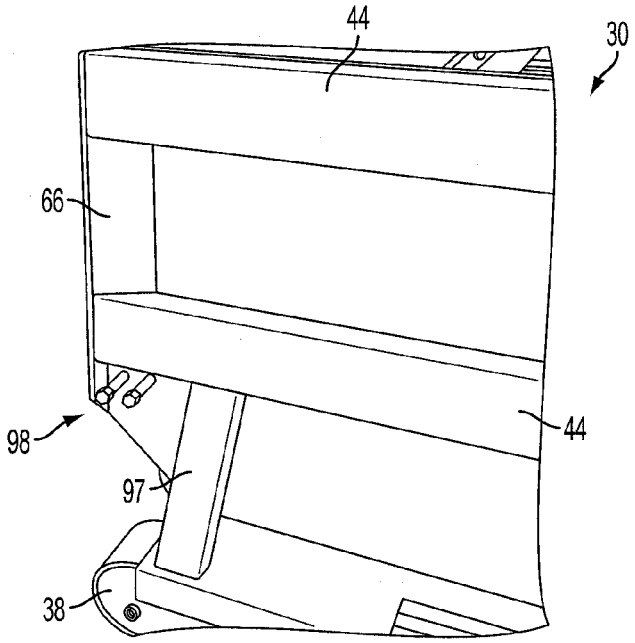
FIG. 18 is a partial perspective view of the compactor head of FIG. 17, showing a corner detail of the roll-off structure and the fittings for external coupling of the hydraulic lines to a hydraulic pump.

FIGS. 16 and 17 show construction details of the pivot couplings 74 that receive the hydraulic cylinder pivot pins 76 (FIG. 16). In this embodiment, the pivot pin 76 resides between spaced flanges 75 (FIG. 16) that are welded to a section of angle iron that is in turn welded to the rear frame members 63, 64 and to the inside of the side wall 42. A similar spaced-flange pin receptacle is provided for each cylinder 72 at the rear of the ram pusher panel 82. It can be seen in this fully retracted position of the ram carriage 80 (FIGS. 16 and 17) that the ram drive system 780, e.g., the hydraulic cylinders 72, is quite compact and yet accessible from the rear end 35 with the access cover panel 62 removed as shown. The rear rail slider 88 is at the end of its the guide rail 87. The trapezoidal side panel 65 of the ram carriage 80 compactly clears the flanges and weldments of the hydraulic cylinder pin mounting 74. The hydraulic manifold 87 and the telescoping cover 94 are likewise compactly placed and protected behind the rear frame members 63, 64.

In FIG. 18, the external connections are shown leading to the hydraulic manifold 78. These connections are detached from a power source (not shown) when the depicted unit 30, 32 is to be transported, for example, on a roll-off truck. In this case, additional structures under the compactor head 30 include the rails 37 and the rollers 38 shown in FIG. 1. These structures provide additional structural support and can be employed as part of the structural support for the compactor head 30, particularly at the rear frame 60 where the hydraulic cylinders 72 are mounted. For that purpose, a diagonal brace 97 can provide diagonal support in addition to that of gusset plate 66, for example.

Although disclosed primarily with reference to a self-contained vertically loaded horizontal ram compactor, the subject matter as disclosed is useful in connection with a range of compactor applications.

As described herein, a compactor head 30 for compressing material into a compressed material container 32 (FIG. 1) has an inlet opening into a hopper 33, which is fed vertically in the examples, but could be otherwise oriented, for example. The compactor head 30 has a charge box 33 mounted with a body frame formed by various structural members (e.g., 44, 50, 52, 54, 60 63, 64). The charge box 33 forms the hopper for receiving material to be compressed. A ram carriage 80, including the ram pusher plate 82, can be positionable in a retracted position adjacent to the hopper 33 (FIGS. 2, 4, 6) and is configured to move along an axis between the first end and the second end of the hopper 33. For example, the ram pusher plate 82 can be driven along a longitudinal path through the charge box 33 from the retracted position toward an opening forming the outlet of the compactor head 30 and the inlet to the compressed material container 32 (FIG. 1). A drive assembly or ram advancing and retracting mechanism 70 mounted on the rear frame 60 advances and retracts the ram carriage 80 to move the ram pusher plate 45 through the charge box 33 toward and away from the inlet opening to the compressed material container 32. In various instances, the ram advancing and retracting mechanism 70 has at least one diagonally mounted extension element, such as the hydraulic cylinder 72, for example coupled between the rear frame 60 and the ram carriage 80.

Referring still to FIGS. 1-23, the frame 60 defines a rear opening 61 (FIG. 5) between the frame members 63, 64 (and 65) including spaced vertical stiles 63 and spaced horizontal top and bottom headers 64. The rear opening 61 provides access to the ram advancing and retracting mechanism 70 positioned within the compactor head 30. In other words, a continuous, unobstructed opening 61 can be defined by the frame 60, such as by the frame members 63 and/or 64, for example, and can extend from the rear end 35 of the compactor head 30, past the drive assembly 70, and to the ram assembly 80, for example (see, e.g., FIGS. 17 and 19).

Referring still to FIGS. 1-23, the ram carriage 80 comprises the ram pusher plate 82, for example as a panel reinforced by cross members 83, 84 on the rear, and side walls 85. The ram carriage 80 generally forms a piston that is guided between the sidewalls 42 and the bottom walls 43, which are attached within the frame 60. The advancing and retracting mechanism 70 can include two diagonally crossing hydraulic cylinders 72, each attached at one end to the rear corners of the frame 60 and at an opposite end to the ram carriage 80 via the reinforcing cross members 83 and/or 84, for example. Moreover, the hydraulic cylinders 72 can be configured to pivot on their ends such that the cylinders 72 align more parallel to the longitudinal path when the ram carriage 80 is advanced, and more perpendicular to the longitudinal path when the ram carriage 80 is retracted.

A sliding top cover 92 is carried forward with the ram pusher plate 82 to cover over an area behind the ram pusher plate 82 when the ram carriage 80 is advanced to move the ram pusher plate 82 through the hopper 33. The cover 92 can have plural cover panels, for example, which can be arranged to telescopically overlap. In the depicted example, a cover panel 92 is attached to the ram pusher plate 82, a fixed panel 95 is attached to the rear end 35 of the frame 60, and a free telescoping cover panel 94 slides between the fixed rear panel 95 and the ram cover panel 92. The free telescoping panel 94 and the cover panel 92 fixed to the ram pusher 82 can reside underneath the fixed rear sliding cover panel 95, for example. In various instances, all three cover panels 92, 94, and 95 are located behind the horizontal top header 64 forming the rear opening 61 of the frame 60, and thus do not interfere with access to the interior of the compactor head 30.

A hydraulic manifold 78 having hydraulic connection lines is also located behind at least one of the frame members 63, 64 defining the rear opening 61, and in the depicted embodiment is behind the horizontal bottom header 64 at the rear opening 61.

The ram assembly 80 can be guided between the side panels 42 and a bottom panel 43, which define the inside surfaces of the hopper 33. Side and bottom panels 42, 43 are attached inside the longitudinal side and bottom supports 44, 99 and provide surfaces that are passed over by the ram pusher plate 82. Moreover, in various instances, the ram assembly 80 can be carried directly on side and bottom panels 42, 43 and, in an alternative embodiment, the ram can carried along elongated guide rails 87 extending along sidewalls of the hopper 33 and supported on the frame 60. Riders 88 are provided on lateral sides of the ram assembly 80, the riders 88 being slidable along the guide rails 87 for carrying the ram assembly 80 through the hopper 33, for example.

The riders 88 extend forwardly and rearwardly beyond the ram pusher plate 45. In various instances, the riders 88 can comprise sliding shoes at corners that reside at the end of the rails 87 in a fully advanced position of the ram assembly 80, for example, and at the rear ends of the rails 87 adjacent to the rear opening 61 at a fully retracted position of the ram assembly 80, for example.

The ram assembly 80 can function as a piston and, in addition to the pusher plate 82, can have ram side panels 85 and optionally a bottom panel or reinforcement 83, attached to the ram pusher plate 82. The side panels 85 of the ram assembly 80 can have a trapezoidal shape that is wider at the top, adjacent to the guide rails 87, and narrower adjacent to the bottom of the hopper 33. In various instances, this arrangement can permit limited flexing of the ram assembly 80.

The ram assembly 80 and the corresponding drive mechanism 70 can fit compactly into the rear portion of the compactor head 30 when the ram assembly 80 is retracted. The rear opening 61 of the frame 60 can be covered by a removable access panel 62, but when the access panel 62 is removed, all the hydraulic cylinders 72 and their hydraulic lines and couplings 78, as well as their mechanical pivoting couplings 74, at the ends can be easily accessible for service.

Referring now to FIGS. 24-27, a compactor head 130, similar to the compactor head 30, for example, can include sidewalls or side panels 142 and a bottom side or panel 143, which can define a charge box or hopper 133. Additionally, vertically spaced side supports 144, vertical flanges 165 and gussets 166, vertical stiles 155, laterals flanges 154, and buttress members 199 can support the sidewalls 142 and/or the bottom panel 143 of the compactor head 130. The compactor head 130 can also include an engagement structure 150, which can be similar to the engagement structure 50, for example, for engaging a compressed material container, such as the container 32 (FIG. 1), for example. The engagement structure 150 can include an engagement header 152, the lateral flanges 154, and/or the vertical stiles 155, for example. As described herein with reference to engagement structure 50, the engagement structure 150 can be positioned within a compressed material container, such as the container 32, for example, and can secure the compactor head 30 relative to the container 32 and support the compactor head 130 and a ram assembly 180 thereof, for example, during operation.

In various instances, the compactor head 130 can further include the ram assembly 180 and a drive assembly 170 operably coupled to the ram assembly 180. Similar to the ram assembly 80, the ram assembly 180 can include a ram pusher plate 182 having a pushing face plate 145 facing the charge box 133. In various instances, the drive assembly 170 can drive the ram assembly 180 along a longitudinal axis, such that the pusher plate 182 and the face plate 145 of the ram assembly 180 move through the charge box 133, for example. Moreover, the drive assembly 170 can include an extension element 172, which can be a longitudinally extending hydraulic cylinder, for example. In various instances, the hydraulic cylinder 172 can be mounted to a frame 160 of the compactor head 130, and can be connected to the pusher plate 182 movably positioned within the compactor head 130. In such instances, longitudinal extension of the hydraulic cylinder 172 can drive the ram assembly 180, including the face plate 145, through the hopper 133 and toward an opening in the compressed material container attached thereto, for example. Similar to the ram assembly 80, in various instances, the ram assembly 180 can include reinforcing bars and/or side and/or bottom panels, for example. Moreover, the ram assembly 180 can be configured, structured and sized to slide along supporting guide rails or runners 187, which can protrude inward from the sidewalls 142 of the compactor head 130. For example, guide rail(s) 187 can extend along the length of the sidewalls 142, and movable riders or sliders 188 can be configured to slide along the guide rail(s) 187 to support and guide the ram assembly 180 during a compaction cycle. For example, the riders 188 can be mounted to and/or fixed relative to the ram assembly 180. In various instances, the compactor head 132 can further include a top cover, which can fixed, movable, and/or telescoping, for example.

Referring still to FIGS. 24-27, in various instances, the frame 160 at the rear end 135 of the compactor head 130 can include the vertical frame members 163 and the horizontal frame members 164. For example, the frame 160 can include a pair of horizontal frame members 164 and pair of vertical frame members 163, which can define an access opening 161*a*, 161*b* therebetween. The access opening 161*a*, 161*b* can provide a continuous, unobstructed opening into the interior of compactor head 130 when a rear access cover or plate has been removed. For example, a rear access cover, similar to the access cover 62, for example, can be removably fastened to the frame 160, such that the cover overlaps or covers the access opening 161*a*, 161*b*. When the access cover is removed and/or unfastened from the frame 160, the ram assembly 180 and the drive assembly 170 can be accessible and/or unconcealed. In such instances, an operator and/or service personnel can easily view and access the interior working components of the compactor head 130.

Figure 24:
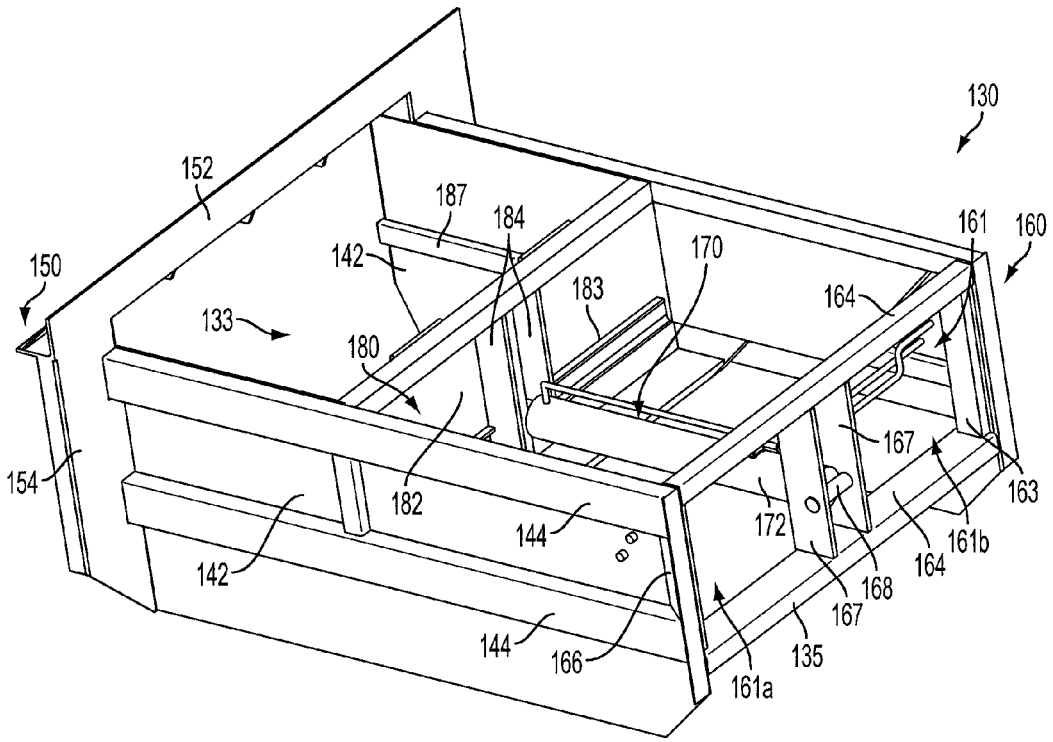
FIG. 24 is a front perspective view of a compactor head, wherein a rear access cover has been removed for illustrative purposes, according to various embodiments of the present disclosure.
Figure 25:
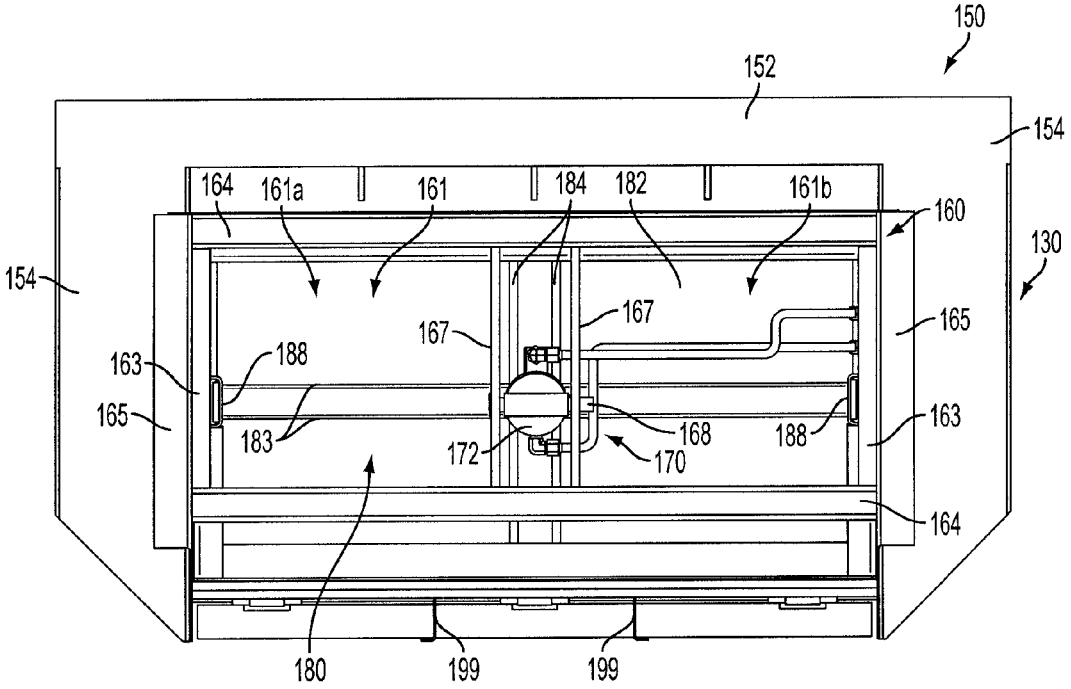
FIG. 25 is a rear end elevation view of the compactor head of FIG. 24, wherein the rear access cover has been removed for illustrative purposes, according to various embodiments of the present disclosure.
Figure 26:
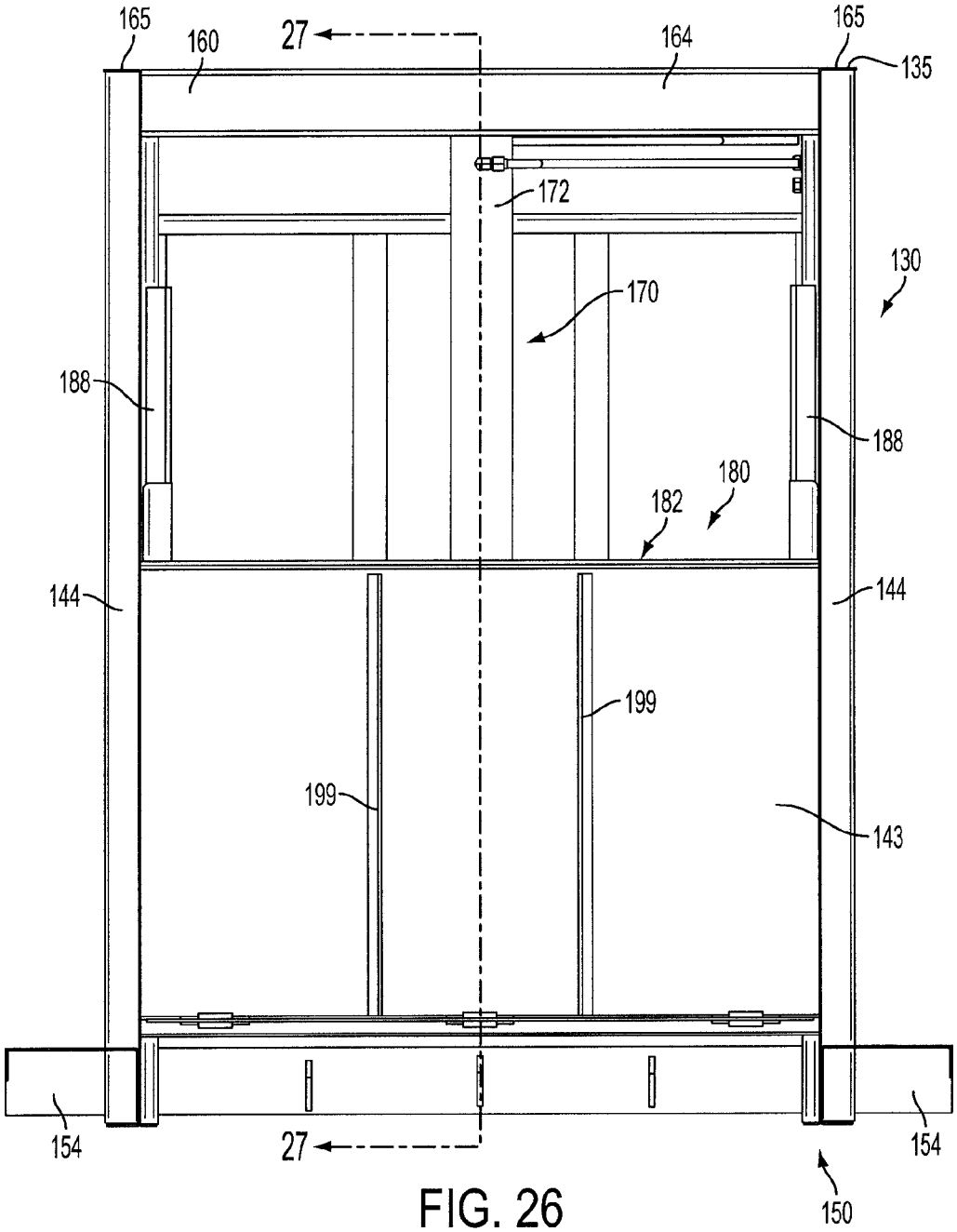
FIG. 26 is a top plan view of the compactor head of FIG. 24, wherein the rear access cover has been removed for illustrative purposes, according to various embodiments of the present disclosure.
Figure 27:
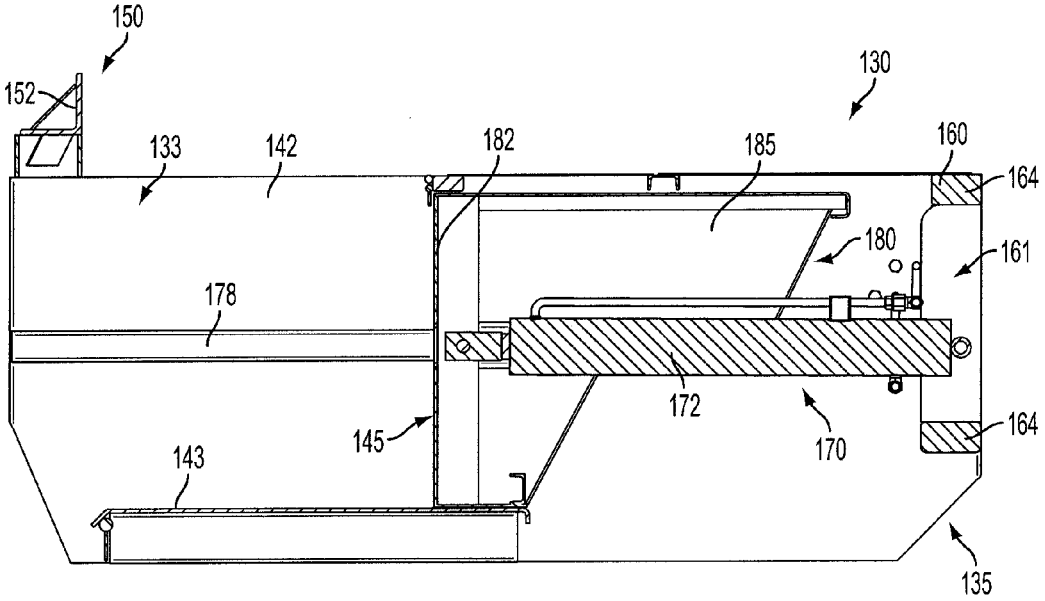
FIG. 27 is a side elevation cross-sectional view of the compactor head of FIG. 24, wherein the rear access cover has been removed for illustrative purposes, taken along the plane indicated in FIG. 26, according to various embodiments of the present disclosure.

In certain instances, referring primarily to FIGS. 24 and 25, the frame 160 of the compactor head 130 can support the longitudinally extending hydraulic cylinder 172 at a central position within the compactor head 130 and/or relative to the leading face plate 145 (FIG. 27). For example, the frame 160 can include central vertical supports 167 and a mounting pin 168 positioned therebetween. The hydraulic cylinder 172 can be mounted to the central vertical supports 167 via the mounting pin 168, for example. In such instances, the frame 160 can define a pair of continuous openings 161*a*, 161*b* on either side of the vertical supports 167 and the hydraulic cylinder 172, and such continuous openings 161*a*, 161*b* can extend from between the horizontal frame members 164 and from the rear end 135 of the compactor head 130 to the ram assembly 180, for example.

Although the present invention has been described herein in connection with certain disclosed embodiments, many modifications and variations to those embodiments may be implemented. Also, where materials are disclosed for certain components, other materials may be used. The foregoing description and following claims are intended to cover all such modification and variations.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

We claim:

1. A compactor, comprising:

a first sidewall;

a second sidewall;

a bottom wall extending between the first sidewall and the second sidewall, wherein the first sidewall, the second sidewall, and the bottom wall define a receptacle having a top, a first end and a second end;

a ram assembly positioned within the receptacle, wherein the ram assembly comprises a leading face configured to translate relative to an axis that extends between the first end and the second end of the receptacle;

a drive assembly coupled to the ram assembly, wherein the drive assembly comprises a drive cylinder;

a frame positioned at the first end of the receptacle, wherein the drive cylinder is mounted to the frame, and wherein the frame comprises:

a lower longitudinal support member extending between the first sidewall and the second sidewall;

an upper longitudinal support member extending between the first sidewall and the second sidewall at the top of the receptacle, wherein a continuous opening is defined between the upper longitudinal support member and the lower longitudinal support member and extending from the first end of the receptacle to the ram assembly, and wherein the drive cylinder is positioned within the continuous opening; and a pair of lateral support members extending between the lower longitudinal support member and the upper longitudinal support member; and a removable cover fastened to the frame, wherein the removable cover overlaps the continuous opening when the removable cover is fastened to the frame.

2. The compactor of claim 1, wherein the frame further comprises a central bracket mounted intermediate the lower longitudinal support member and the upper longitudinal support member.

3. The compactor of claim 2, wherein the drive cylinder comprises a first end and a second end, wherein the first end is mounted to the central bracket, and wherein the second end is mounted to the ram assembly.

4. The compactor of claim 3, wherein the drive cylinder extends parallel to the axis.

5. The compactor of claim 1, wherein the upper longitudinal support member and the lower longitudinal support member each comprise an angle iron bar.

6. The compactor of claim 1, further comprising a container secured to the second end of the receptacle.

7. The compactor of claim 6, wherein the receptacle and the container form a unitary assembly.

8. A compactor, comprising:

a first sidewall;

a second sidewall;

a bottom wall intermediate the first sidewall and the second sidewall, wherein the first sidewall, the second sidewall, and the bottom wall define a receptacle, and wherein the receptacle comprises a first end and a second end;

a frame positioned at the first end, wherein the frame comprises:

a first longitudinal support member extending between the first sidewall and the second sidewall;

a second longitudinal support member extending between the first sidewall and the second sidewall, wherein an unobstructed opening is defined between the first longitudinal support member and the second longitudinal support member, and wherein the unobstructed opening has a length between the first longitudinal support member and the second longitudinal support member;

a first lateral support member extending between the first longitudinal support member and the second longitudinal support member; and a second lateral support member extending between the first longitudinal support member and the second longitudinal support member;

a removable cover removably positioned over the unobstructed opening;

a ram assembly positioned within the receptacle, wherein the ram assembly comprises a leading face configured to translate relative to an axis that extends between the first end and the second end of the receptacle; and a drive assembly coupled to the ram assembly, wherein the drive assembly comprises:

a first hydraulic cylinder mounted to the frame between the first longitudinal support member and the second longitudinal support member, wherein the first hydraulic cylinder has a first diameter; and a second hydraulic cylinder mounted to the frame between the first longitudinal support member and the second longitudinal support member, wherein the second hydraulic cylinder has a second diameter, and wherein the length of the unobstructed opening between the first longitudinal support member and the second longitudinal support member is at least 190% the sum of the first diameter and the second diameter.

9. The compactor of claim 8, further comprising a telescoping lid.

10. The compactor of claim 8, wherein the frame further comprises a corner brace.

11. The compactor of claim 8, wherein the frame further comprises:

a first bracket mounted to the first lateral support member, wherein the first hydraulic cylinder is pivotably mounted to the first bracket; and a second bracket mounted to the second lateral support member, wherein the second hydraulic cylinder is pivotably mounted to the second bracket.

12. The compactor of claim 8, wherein the first hydraulic cylinder is angularly oriented relative to the second hydraulic cylinder.

13. The compactor of claim 8, wherein the first longitudinal support member and the second longitudinal support member each comprise an angle iron bar.

14. The compactor of claim 8, further comprising a container secured to the second end of the receptacle.

15. The compactor of claim 8, wherein the drive assembly further comprises a hydraulic manifold positioned intermediate the frame and the leading face of the ram assembly, wherein the hydraulic manifold is aligned with the second longitudinal support member and offset from the unobstructed opening.

16. A compactor, comprising:

a first sidewall;

a second sidewall;

a bottom wall intermediate the first sidewall and the second sidewall, wherein the first sidewall, the second sidewall, and the bottom wall define a receptacle, and wherein the receptacle comprises a first end and a second end;

a frame positioned at the first end, wherein the frame comprises:

a pair of lateral support members;

a lower longitudinal support member comprising a guard surface; and an upper longitudinal support member, wherein a continuous opening is defined between the lateral support members, the upper longitudinal support member, and the lower longitudinal support member;

a removable cover removably positioned over the continuous opening;

a ram assembly positioned within the receptacle, wherein the ram assembly comprises a leading face configured to translate relative to an axis that extends between the first end and the second end of the receptacle; and a drive assembly coupled to the ram assembly, wherein the drive assembly comprises:

a hydraulic cylinder mounted to the frame and aligned with the continuous opening; and a hydraulic manifold positioned intermediate the frame and the leading face of the ram assembly, wherein the hydraulic manifold is aligned with the guard surface and offset from the continuous opening.

17. The compactor of claim 16, wherein the upper longitudinal support member comprises a second guard surface, and wherein the ram assembly further comprises a trailing face aligned with the second guard surface.

18. The compactor of claim 17, wherein the removable cover is releasably bolted to the frame.

19. The compactor of claim 17, further comprising a container secured to the second end of the receptacle.

20. The compactor of claim 17, wherein the receptacle comprises a top, and wherein the upper longitudinal support member is positioned at the top.

* * * * *